US011554460B2

(12) United States Patent
Shibata et al.

(10) Patent No.: US 11,554,460 B2
(45) **Date of Patent: *Jan. 17, 2023**

(54) ROTATING TOOL

(71) Applicant: MAKITA CORPORATION, Anjo (JP)

(72) Inventors: Kenji Shibata, Anjo (JP); Masanori Furusawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 424 days.

This patent is subject to a terminal disclaimer.

(21) Appl. No.: 16/640,281

(22) PCT Filed: Aug. 9, 2018

(86) PCT No.: PCT/JP2018/029978

§ 371 (c)(1),
(2) Date: Feb. 19, 2020

(87) PCT Pub. No.: WO2019/058808

PCT Pub. Date: Mar. 28, 2019

(65) Prior Publication Data

US 2020/0361057 A1 Nov. 19, 2020

(30) Foreign Application Priority Data

Sep. 19, 2017 (JP) ..... JP2017-179282

(51) Int. Cl.
*B24B 47/00* (2006.01)
*B24B 47/26* (2006.01)
(Continued)

(52) U.S. Cl.
CPC ..... *B24B 47/26* (2013.01); *B24B 23/02* (2013.01); *B24B 47/12* (2013.01)

(58) Field of Classification Search
CPC ..... B24B 23/022; B24B 23/028; B24B 47/26; B24B 55/00; H02K 7/106
See application file for complete search history.

(56) References Cited

U.S. PATENT DOCUMENTS

2017/0334056 A1* 11/2017 Kawakami ..... B25F 5/006
2018/0337575 A1* 11/2018 Sengiku ..... H01R 13/516

FOREIGN PATENT DOCUMENTS

DE 3722629 A * 1/1989 ..... B24B 23/028
DE 3722629 A1 1/1989
(Continued)

OTHER PUBLICATIONS

Sep. 25, 2018 Search Report issued in International Patent Application No. PCT/JP2018/029978.
(Continued)

*Primary Examiner* — Eyamindae C Jallow
(74) *Attorney, Agent, or Firm* — Oliff PLC

(57) ABSTRACT

A grinder including a motor, a switch operated ON and OFF in accordance with an operation of a switch lever to control a rotation of an output shaft of the motor, a spindle that rotates in accordance with the rotation of the output shaft to rotate a disk-shaped grinding wheel and a brake mechanism controllable with respect to a brake plate that integrally rotates with the output shaft, in a housing, the brake plate includes fins.

10 Claims, 17 Drawing Sheets

(51) Int. Cl.
*B24B 23/02* (2006.01)
*B24B 47/12* (2006.01)

(56) References Cited

FOREIGN PATENT DOCUMENTS

| | | | | | |
|---|---|---|---|---|---|
| DE | 102014211578 | A1 | * | 12/2015 | ..... B23Q 11/0092 |
| EP | 1647366 | A1 | * | 4/2006 | ..... B24B 23/028 |
| EP | 1938924 | A1 | * | 7/2008 | ..... B24B 23/028 |
| EP | 2138279 | A1 | * | 12/2009 | ..... B24B 23/028 |
| JP | S49-38884 | U | | 4/1974 | |
| JP | S56-127829 | A | | 10/1981 | |
| JP | S60-112732 | U | | 7/1985 | |
| JP | 2011-183516 | A | | 9/2011 | |
| JP | 2011183516 | A | * | 9/2011 | ..... B24B 23/028 |
| JP | 2017-13163 | A | | 1/2017 | |
| JP | 2017013163 | A | * | 1/2017 | |
| WO | WO-2012055652 | A2 | * | 5/2012 | ..... B23Q 11/0092 |
| WO | WO-2018235680 | A1 | * | 12/2018 | ..... B24B 23/028 |

OTHER PUBLICATIONS

Jun. 2, 2021 Office Action issued in Japanese Patent Application No. 2017-179282.
Sep. 25, 2018 Written Opinion of the International Searching Authority issued in International Patent Application No. PCT/JP2018/029978.
Aug. 2, 2022 Office Action issued in Chinese Patent Application No. 201880058751.5.

* cited by examiner

ROTATING TOOL

BACKGROUND OF THE INVENTION

This application claims the benefits of International Application No. PCT/JP2018/029978, filed on Aug. 9, 2018 and Japanese Patent Application No. 2017-179282 filed on Sep. 19, 2017, the entirety of which is incorporated by reference.

TECHNICAL FIELD

The present invention relates to a rotating tool, such as a grinder, that rotates a tool bit.

BACKGROUND ART

In a rotating tool, such as a grinder, that performs an operation by rotating a tool bit, such as a disk-shaped grinding wheel, a braking mechanism is disposed in order to stop an inertial rotation of the tool bit in a short period of time when the operation is terminated.

As illustrated in German Patent Application Publication No. 3722629, the braking mechanism is to apply a brake to an output shaft by pressing a brake plate disposed in a rear end of the output shaft of a motor with a brake shoe biased by a coil spring in an ordinary state. In use, a push-in operation of an operation member, such as a paddle switch, turns a switch ON and separates the brake shoe from the brake plate by a lever that rotates in conjunction with the operation member, and thus, the braking is released. Releasing the push-in operation of the operation member turns the switch OFF and presses the brake shoe onto the brake plate, and thus, the brake is applied.

DISCLOSURE OF THE INVENTION

However, since a large-sized grinder has a large tool bit, such as a disk-shaped grinding wheel, in addition to a motor, a large inertia is generated. Therefore, heat generation of the brake mechanism is increased in braking when a brake shoe is pressed by a rotating brake plate, thereby possibly leading to degradations of brake characteristics and component service life.

Therefore, an object of the present invention is to provide a rotating tool that reduces heat generation at braking to ensure reducing degradations of brake characteristics and component service life.

In order to achieve the above-described object, there is provided a rotating tool according to the present invention. The rotating tool includes a motor, a switch, a rotation shaft, and a brake mechanism. The motor is disposed in a housing. The switch is disposed in the housing. The switch is operated ON and OFF in accordance with an operation of an operation member to control a rotation of an output shaft of the motor. The rotation shaft is disposed in the housing. The rotation shaft rotates in accordance with the rotation of the output shaft to rotate a tool bit. The brake mechanism is disposed in the housing. The brake mechanism is controllable with respect to a brake plate that integrally rotates with the output shaft. The brake plate includes a fin.

In this case, it is preferred that the brake plate is made of a disk-shaped metal, and a plurality of the fins are disposed upright in a radial direction of the brake plate and formed at regular intervals in a circumferential direction of the brake plate.

It is also preferred that the brake plate has a center on which a cylindrical portion extending to a side of the output shaft is integrally formed, and the cylindrical portion is externally mounted on and key-connected to a coupling shaft disposed coaxially with the output shaft.

It is also preferred that the fin is disposed upright on an outer periphery portion of the brake plate, and the brake plate is retained by a circular plate and a bolt. The circular plate is in contact with a center on an inner side of the fin. The bolt passes through the circular plate to be threadably mounted on a center of the coupling shaft.

It is also preferred that the brake mechanism includes a cylinder-shaped shoe holder, a cylinder-shaped base, and biasing means. The cylinder-shaped shoe holder holds a brake shoe that brakes the brake plate by abutting on the brake plate. The cylinder-shaped base holds the shoe holder movable forward and rearward with respect to the brake plate. The biasing means biases the shoe holder to a side of the brake plate. On any one of an outer peripheral surface of the shoe holder or an inner peripheral surface of the base, an inclination groove that inclines with respect to an axial direction of the shoe holder is formed. On another of the outer peripheral surface of the shoe holder or the inner peripheral surface of the base, a protrusion that fits to the inclination groove is formed. The shoe holder, while rotating by a guide of the inclination groove and the protrusion, brings the brake shoe into contact with the brake plate when the shoe holder moves to the brake plate side.

It is also preferred that the brake mechanism includes a linking mechanism between the operation member and the shoe holder. The linking mechanism links with a movement of the operation member to move the shoe holder forward and rearward. The linking mechanism includes a slide body and a conversion member. The slide body, in conjunction with the operation member, slides along a moving direction of the operation member. The slide body includes a guide portion. The conversion member includes a sliding portion that slides on the guide portion. The conversion member moves in a direction of advance and retreat of the shoe holder corresponding to a movement of the guide portion in accordance with sliding of the slide body to move the shoe holder forward and rearward. At least two of the guide portions are disposed to move the conversion member in response to sliding of the slide body in conjunction with an operation of the operation member from at least the switch being in an OFF state until being operated ON, and amounts of movement of the conversion member between the neighboring guide portions are mutually different.

It is also preferred that an amount of movement of the conversion member whose sliding portion slides by the guide portion first is larger than an amount of movement of the conversion member whose sliding portion slides by the guide portion later.

It is also preferred that the rotating tool includes a shaft member that slidably guides the slide body along a moving direction of the operation member.

It is also preferred that the rotating tool includes a seal member that seals between the shoe holder and the base.

It is also preferred that the biasing means is a plurality of coil springs arranged on a concentric circle about an axial center of the shoe holder.

It is also preferred that the linking mechanism is unitized by housing at least the slide body and the conversion member in a holding case, and the holding case is supported in the housing.

It is also preferred that the housing includes a motor housing that houses the motor and a handle housing coupled to a rear of the motor housing. A vibration absorbing member is interposed between the motor housing and the handle housing. At least a part of the brake mechanism is arranged inside the vibration absorbing member.

With the present invention, since the fin is disposed on the brake plate, a heat radiation effect is obtained. Accordingly, the heat generation at braking is reduced to ensure reducing degradations of brake characteristics and component service life.

In particular, the shoe holder, while rotating by a guide of the inclination groove and the protrusion, brings the brake shoe into contact with the brake plate when the shoe holder moves to a side of the brake plate. Therefore, braking force is increased when the brake shoe is brought into contact with the brake plate.

In particular, at least two of the guide portions for the conversion member are disposed so as to have mutually different amounts of movement of the conversion member. Therefore, releasing and braking operation of the brake mechanism is adjusted to a timing of ON and OFF operation of the switch, and a necessary force to continue pushing in the operation member is reduced after the switch is operated ON. Accordingly easy operation of the operation member is ensured.

In particular, the amount of movement of the conversion member whose sliding portion slides by the guide portion first is made larger than the amount of movement of the conversion member whose sliding portion slides by the guide portion later. Therefore, the braking on the brake plate is quickly released by increasing of the amount of movement of the conversion member at an operation initial stage of operation member.

In particular, the shaft member is provided so as to slidably guide the slide body along the moving direction of the operation member. Therefore, the shaft member receives the load applied to the slide body from the conversion member. Accordingly, even though the linking mechanism is disposed, the load at the push-in operation of the operation member can be reduced.

In particular, the seal member is disposed so as to seal between the shoe holder and the base. Therefore, a dust-proof between the shoe holder and the base is maintained even though an inside of the shoe holder is ventilated, thereby ensuring a smooth front-rear movement of the shoe holder.

In particular, the biasing means is the plurality of coil springs arranged on the concentric circle about the axial center of the shoe holder. Therefore, the coil spring is arranged so as to overlap the bearing portion of the output shaft, thereby ensuring achieving downsizing in the axial direction even though the brake mechanism is disposed in the rear of the output shaft.

In particular, the linking mechanism is unitized and the holding case is supported in the housing. Therefore, assemblability of the linking mechanism is improved, and interference with another wiring is reduced to lead to a protection of wiring.

In particular, the vibration absorbing member is interposed between the motor housing and the handle housing, and at least a part of the brake mechanism is arranged inside the vibration absorbing member. Therefore, a space inside the vibration absorbing member is effectively utilized.

BRIEF DESCRIPTION OF THE DRAWINGS

FIG. 17 is an enlarged view of the brake mechanism portion when the switch is turned ON.

DESCRIPTION OF PREFERRED EMBODIMENTS

The following describes embodiments of the present invention based on the drawings.

Figure 1:
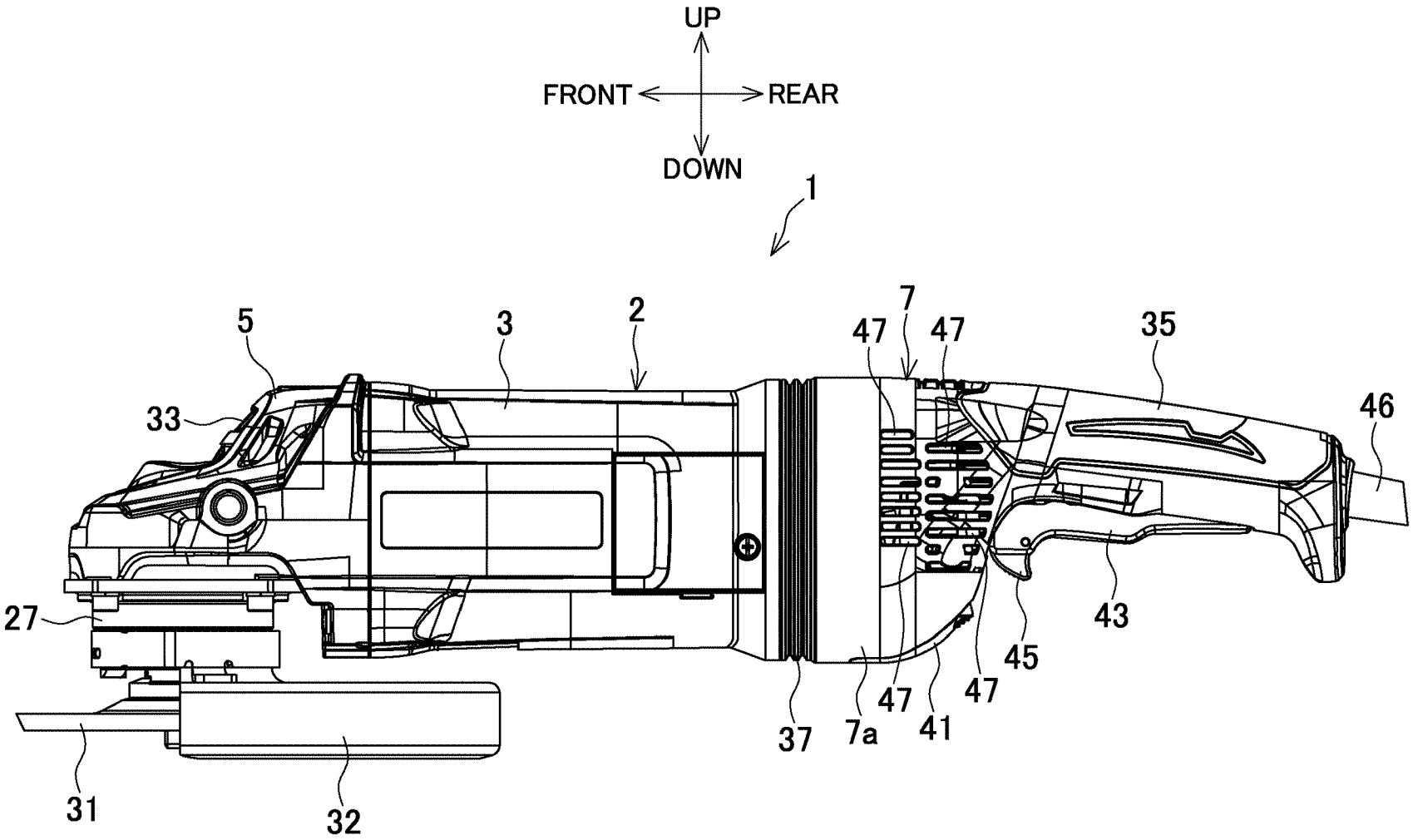
FIG. 1 is a side view of a grinder.
Figure 2:
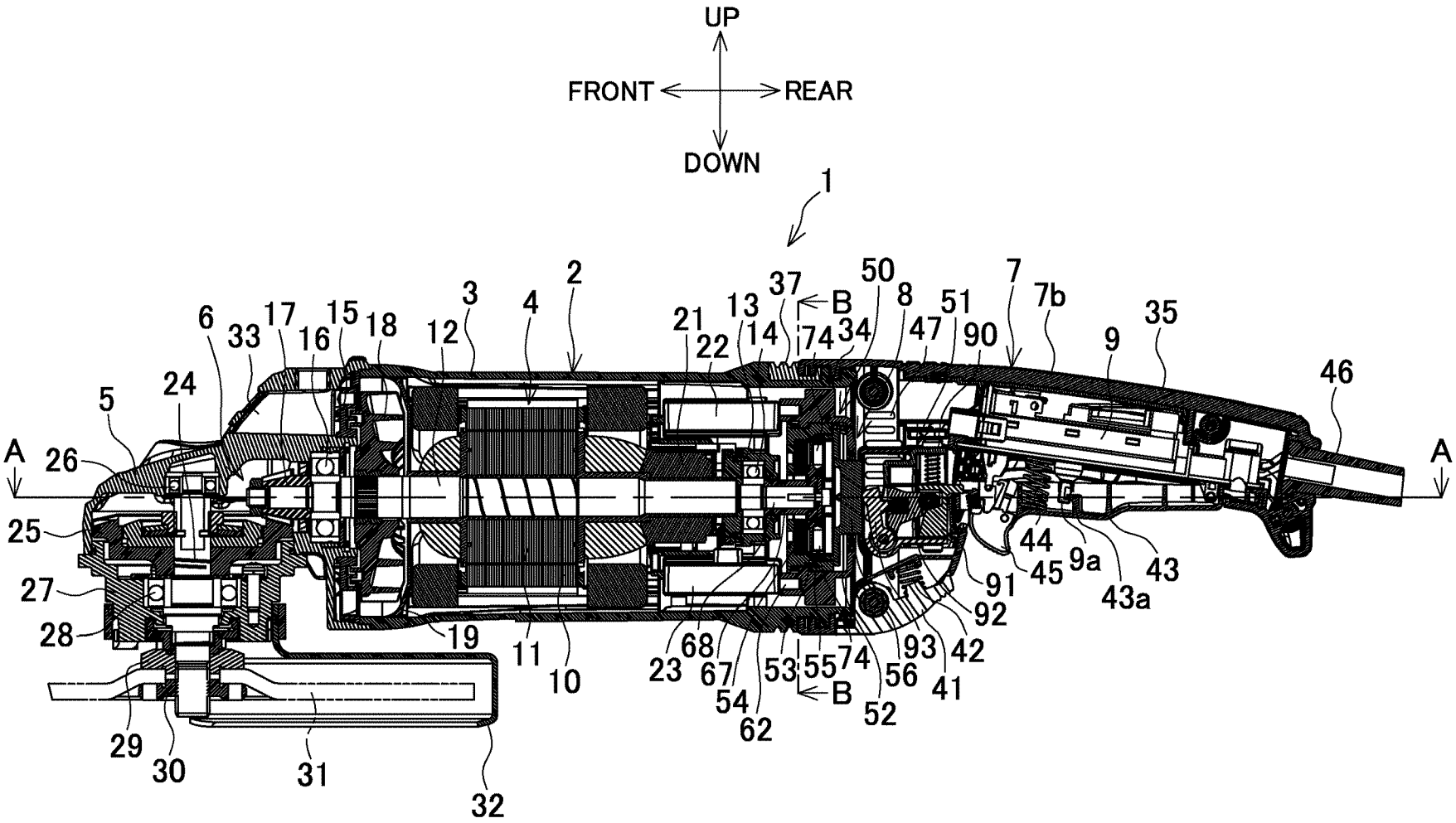
FIG. 2 is a center vertical cross-sectional view of the grinder.
Figure 3:
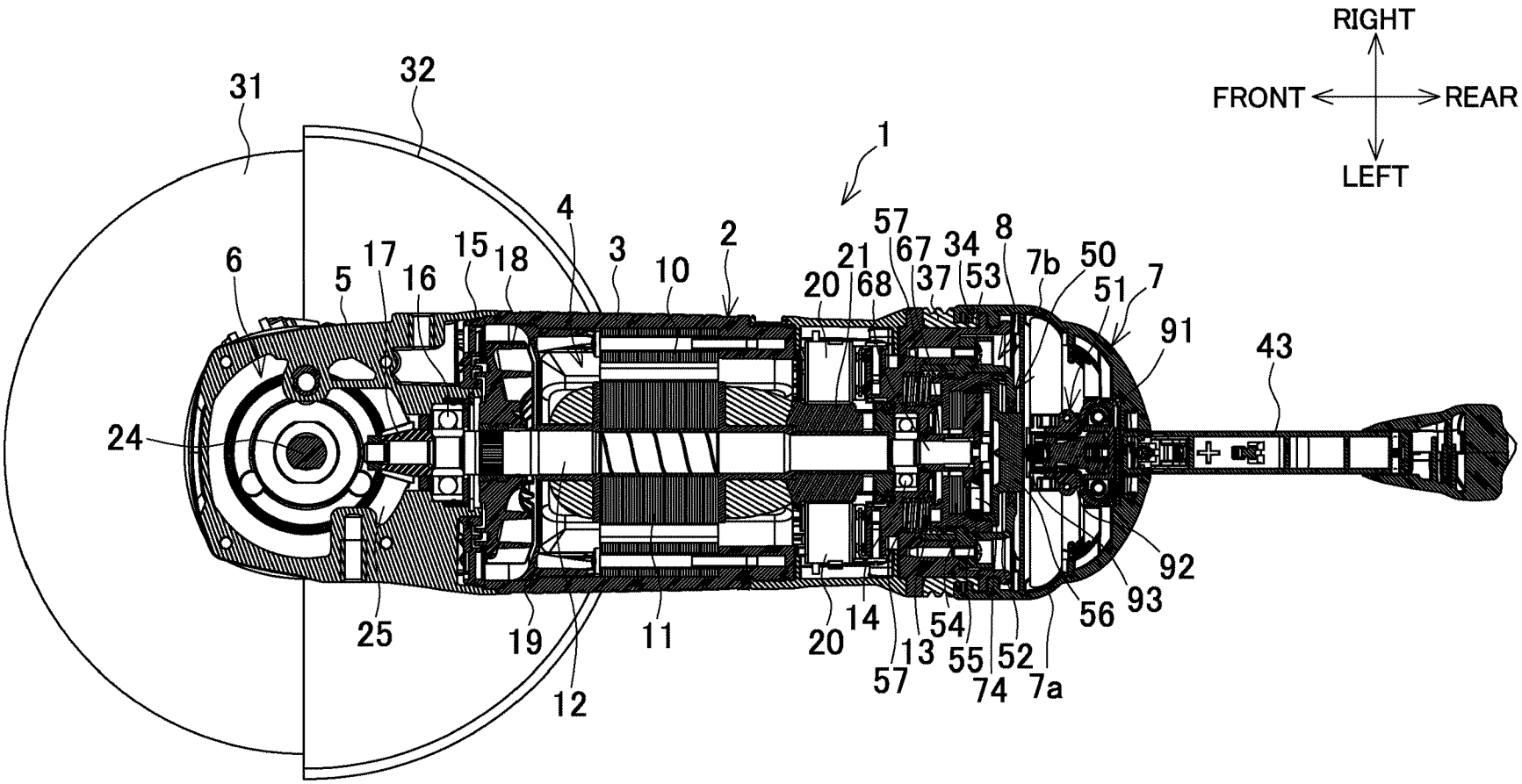
FIG. 3 is a cross-sectional view taken along a line A-A in FIG. 2.

FIG. 1 is a side view of a grinder illustrating an exemplary rotating tool. FIG. 2 is a center vertical cross-sectional view. FIG. 3 is a cross-sectional view taken along a line A-A in FIG. 2. A housing 2 of the grinder 1 includes a tubular motor housing 3, a gear housing 5, and a handle housing 7. The motor housing 3 houses a motor (commutator motor) 4 and extends in a front-rear direction. The gear housing 5 is assembled to a front of the motor housing 3 to house an output unit 6. The handle housing 7 is assembled to a rear portion of the motor housing 3 to house the brake mechanism 8, the switch 9 and the like.

First, in the motor housing 3, the motor 4 includes a stator 10 and a rotor 11, and is housed in a posture where an output shaft 12 of the rotor 11 is facing forward. The output shaft 12 has a rear end pivotally supported by a bearing 14 held at a bearing portion 13 in the motor housing 3. The output shaft 12 has a front end that passes through a partition plate 15 disposed between the motor housing 3 and the gear housing 5, and is pivotally supported by a bearing 16 held by the gear housing 5 to project into the gear housing 5. At the front end of the output shaft 12, a bevel gear 17 is disposed. At a rear of the partition plate 15, a centrifugal fan 18 is disposed at the output shaft 12. At a rear of the centrifugal fan 18, the motor housing 3 holds a baffle plate 19. Reference numerals 20, 20 in FIG. 3 are brush holders arranged to right and left of a commutator 21 of the rotor 11. As illustrated in FIG. 2, the commutator 21 has upper and lower sides where an upper controller 22 and a lower controller 23 that are formed by housing a substrate in a case are respectively disposed.

In the gear housing 5, a spindle 24 is disposed in an up and down direction. The spindle 24 has an intermediate portion where a bevel gear 25 is disposed. The bevel gear 25 is engaged with the bevel gear 17 of the output shaft 12. The spindle 24 is pivotally supported by an upper side bearing 26 and a lower side bearing 28, and has a lower end projected downward from a retainer 27. The bearing 26 is held in the gear housing 5. The bearing 28 is held by the retainer 27 combined to the lower side of the gear housing 5. A disk-shaped grinding wheel 31 is attachably/detachably mounted on the lower end of the spindle 24 with an inner flange 29 and an outer flange 30. Reference numeral 32 is a wheel cover that is mounted on the retainer 27 and covers a rear half portion of the disk-shaped grinding wheel 31. Reference numerals 33, 33 . . . are exhaust outlets that communicate with a through hole disposed on the partition plate 15 and open to a front surface of the gear housing 5.

Figure 4:
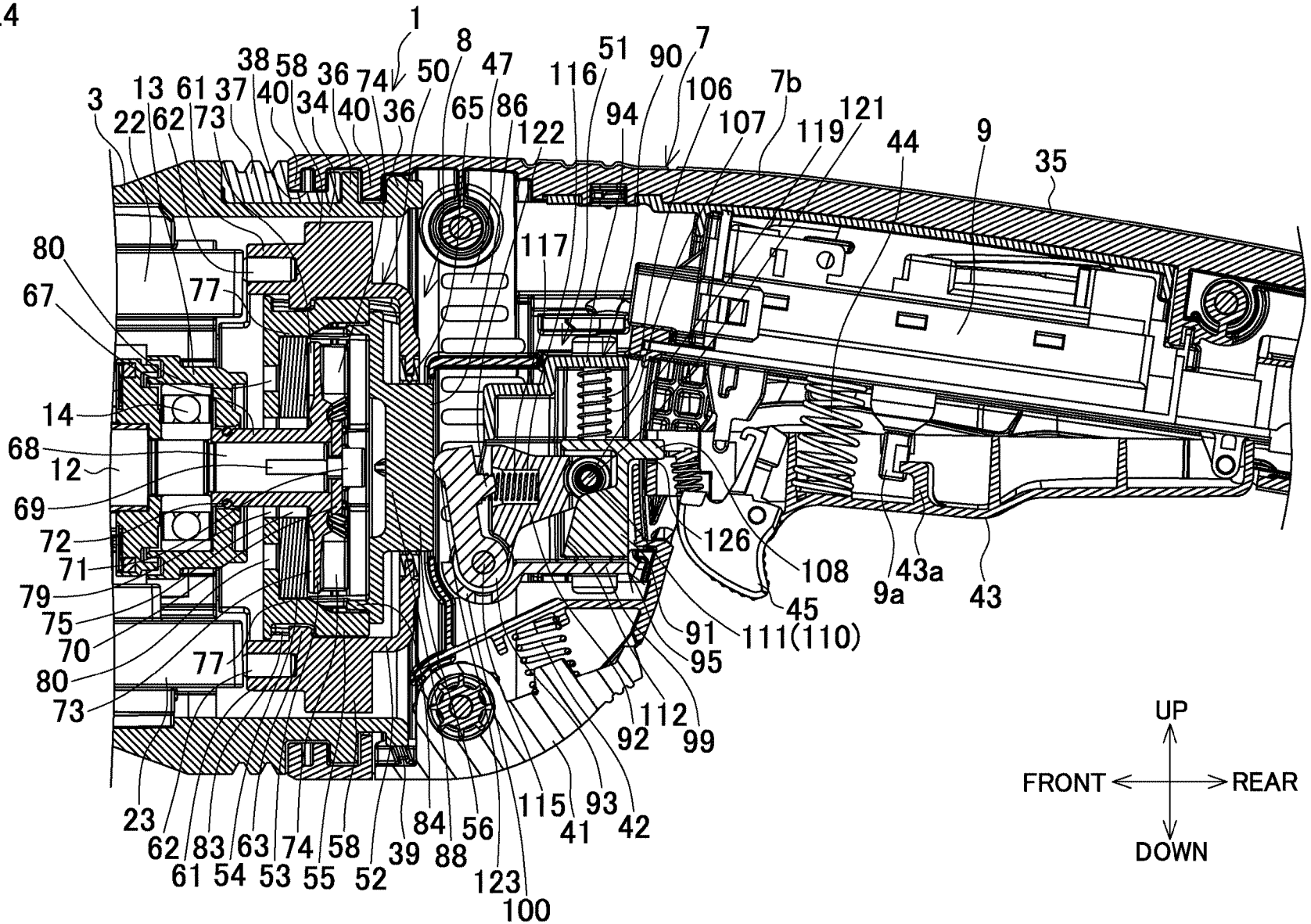
FIG. 4 is an enlarged view of a brake mechanism portion in FIG. 2 (when a switch is turned OFF).
Figure 5:
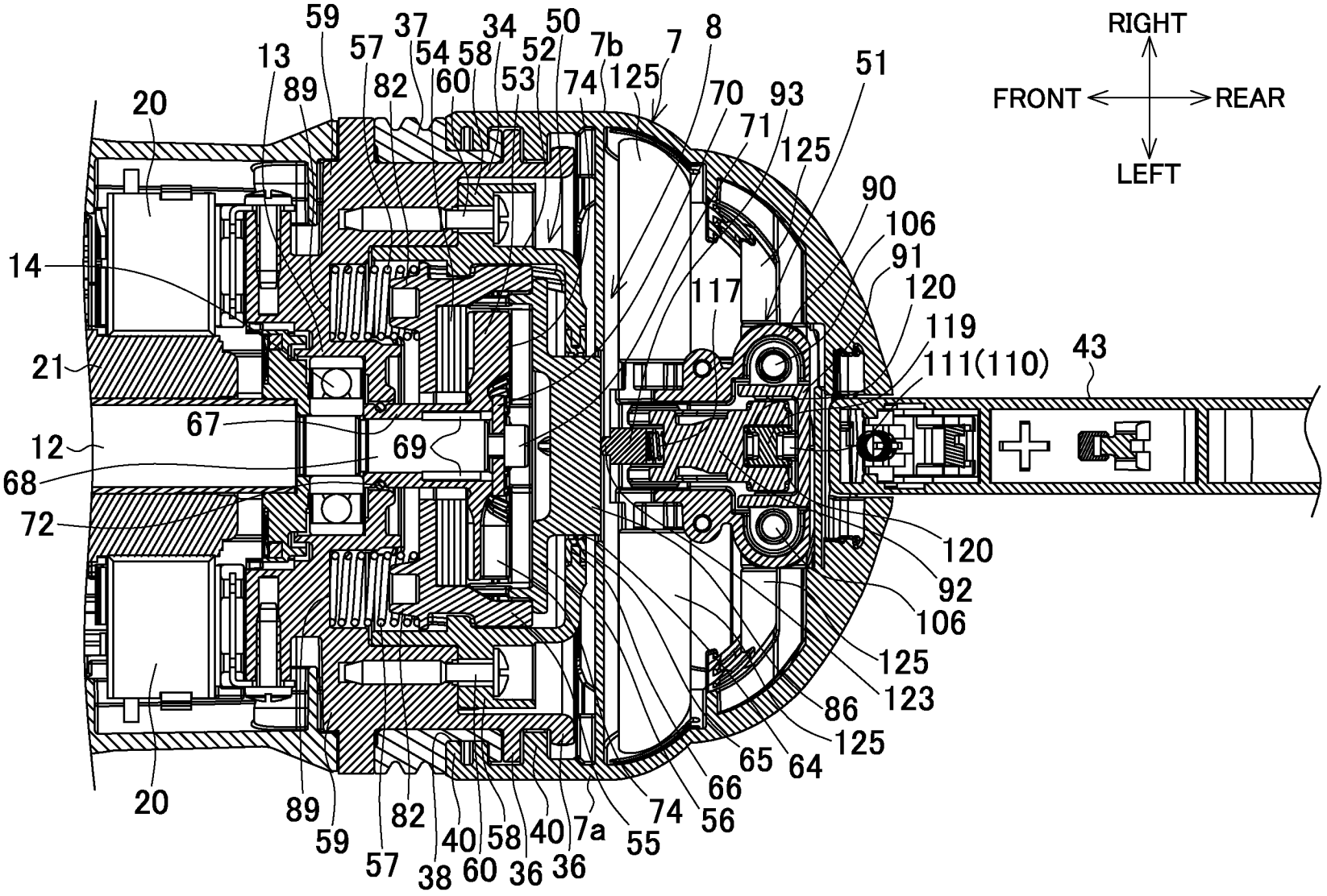
FIG. 5 is an enlarged view of the brake mechanism portion in FIG. 3.
Figure 6:
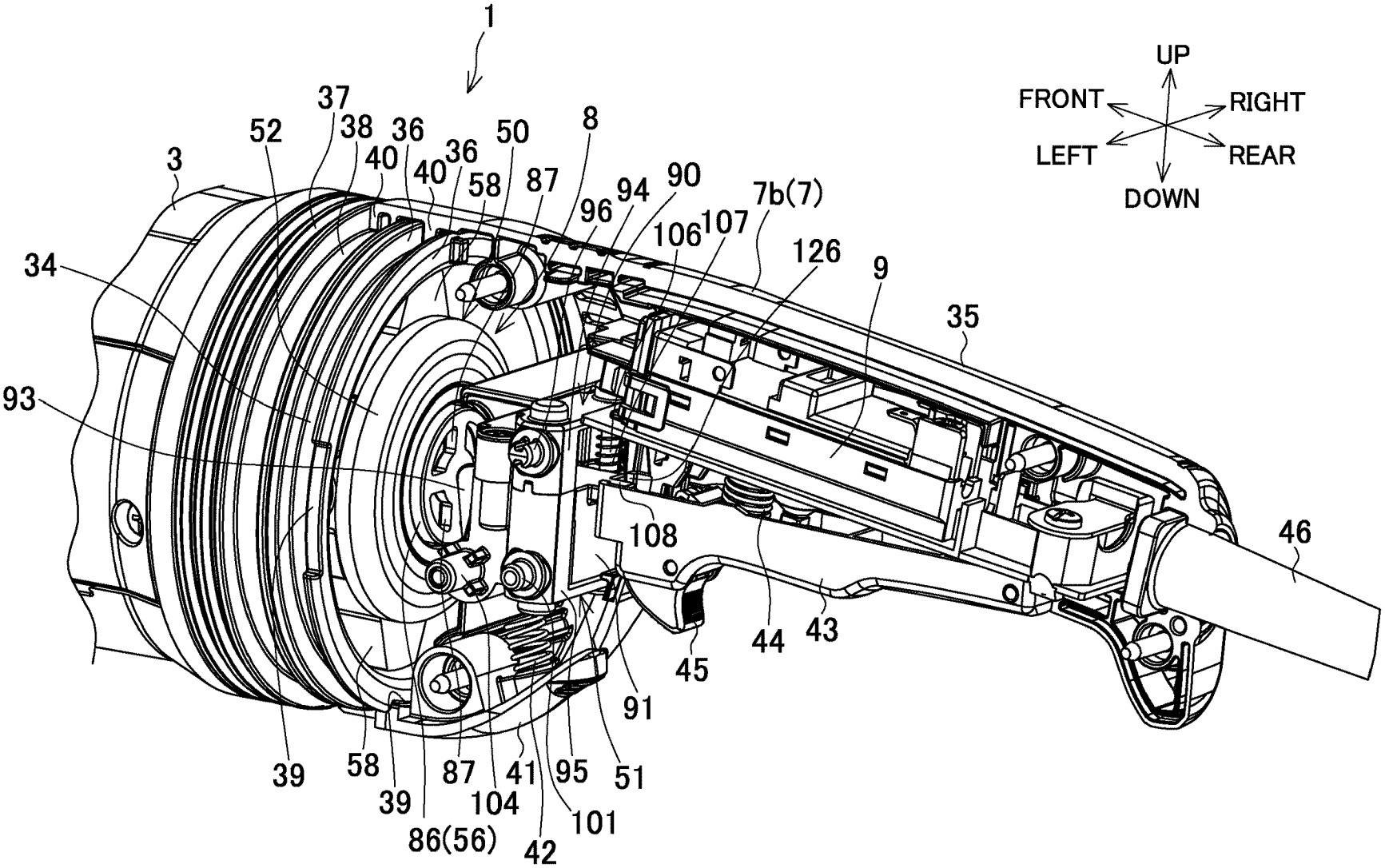
FIG. 6 is a perspective view from a rear of a handle housing portion from which a half housing on a left side is omitted.

Meanwhile, as illustrated in FIGS. 4 to 6, the handle housing 7 is made of a pair of half housings 7*a*, 7*b* assembled with screws from right and left by sandwiching a small-diameter portion 34 disposed in a rear end of the motor housing 3. The handle housing 7 has a rear end where a handle portion 35 extending rearward is formed. On the small-diameter portion 34 of the motor housing 3, outer ribs 36, 36 are circularly disposed outward in a front and a rear. In a front of the outer rib 36 on the front side and on an outer peripheral surface of the small-diameter portion 34, a strip-shaped vibration absorbing rubber 37 in a C-shape in front view with a separated lower end is wound around. The vibration absorbing rubber 37 has an outer surface toward the rear where a depressed groove 38 is circularly disposed. The outer rib 36 on the rear side has right and left sides and a lower portion where cutout portions 39, 39 . . . are formed.

Each of the half housings 7*a*, 7*b* of the handle housing 7 has a front end inner side where two inner ribs 40, 40 are circularly disposed in a front and a rear. The inner ribs 40, 40 each fit in the depressed groove 38 of the vibration absorbing rubber 37 and between the outer ribs 36, 36 of the small-diameter portion 34.

Accordingly, the handle housing 7 in a state of being assembled to the motor housing 3 is elastically held by the inner rib 40 on the front side fitting in the depressed groove 38 of the vibration absorbing rubber 37. The inner rib 40 on the rear side has a slight clearance in a radial direction and the front-rear direction on an outer peripheral surface of the small-diameter portion 34 and between the outer ribs 36, 36 in a fitting state. Therefore, a slight movement in the front-rear direction and the radial direction of the handle housing 7 caused by an elastic distortion of the vibration absorbing rubber 37 is allowed.

The handle housing 7 is rotatable about the small-diameter portion 34. The handle housing 7 has a lower surface side where a lock button 41 is disposed. The lock button 41 is swingably disposed about a screw boss in the lower side where the handle housing 7 is assembled. A front end of the lock button 41 is biased into a posture of pressing the outer rib 36 in the rear side of the small-diameter portion 34 by a coil spring 42 in an ordinary state. Accordingly, at a position where the front end of the lock button 41 is locked in any of the cutout portions 39 of the outer rib 36, the rotation of the handle housing 7 can be locked. Pushing a rear end of the lock button 41 in to a side of the handle housing 7 releases the lock of the front end to allow the rotation.

Furthermore, in the handle portion 35, the switch 9 is held in the front-rear direction in a posture with a plunger 9*a* projecting downward. The handle portion 35 has a lower side where a switch lever 43 is disposed. The switch lever 43 has a front end swingable up and down with the rear end as a fulcrum. The switch lever 43 has an internally disposed lock piece 43*a*. The switch lever 43 is biased at a swing position to the lower side by a coil spring 44 in a state where the lock piece 43*a* is locked to the plunger 9*a*. When a hand gripping the handle portion 35 operates to upwardly push in the switch lever 43, the plunger 9*a* is pushed in to turn the switch 9 ON with the lock piece 43*a*, and when the hand gripping the handle portion 35 releases the push-in of the switch lever 43, the plunger 9*a* projects to turn the switch 9 OFF. The switch lever 43 has a front end where a lock lever 45 is disposed to be rotationally operable to the front and the rear. The lock lever 45 can select a lock off position at which the push-in of the switch lever 43 is restricted, a neutral position at which the push-in of the switch lever 43 is allowed, and a lock on position at which the push-in state of the switch lever 43 is maintained by selecting a rotation position.

The handle portion 35 has a rear end to which a power supply cord 46 is connected. In the front of the handle portion 35 and on the right and the left of the handle housing 7, a plurality of air inlets 47, 47 . . . (for example, FIG. 1) are formed in the front and the rear.

The brake mechanism 8 is formed of a brake portion 50 disposed in a rear portion of the rotor 11 of the motor 4, and a linking unit 51 that is disposed between the brake portion 50 and the switch lever 43 and links the operation of the switch lever 43 and the operation of the brake portion 50.

First, the brake portion 50 includes a base 52 in a shape of a cylinder with a closed bottom with a front portion opened, a brake plate 53, a brake shoe 54, a shoe holder 55, a cap 56, and a pair of coil springs 57, 57. The base 52 is screwed in the motor housing 3 from the rear. The brake plate 53 is disposed in the base 52. The brake shoe 54 is for braking the brake plate 53. The shoe holder 55 holds the brake shoe 54 and has a rear portion opened. The cap 56 obstructs a rear end of the shoe holder 55. The pair of coil springs 57, 57 bias the shoe holder 55 rearward.

Figure 7:
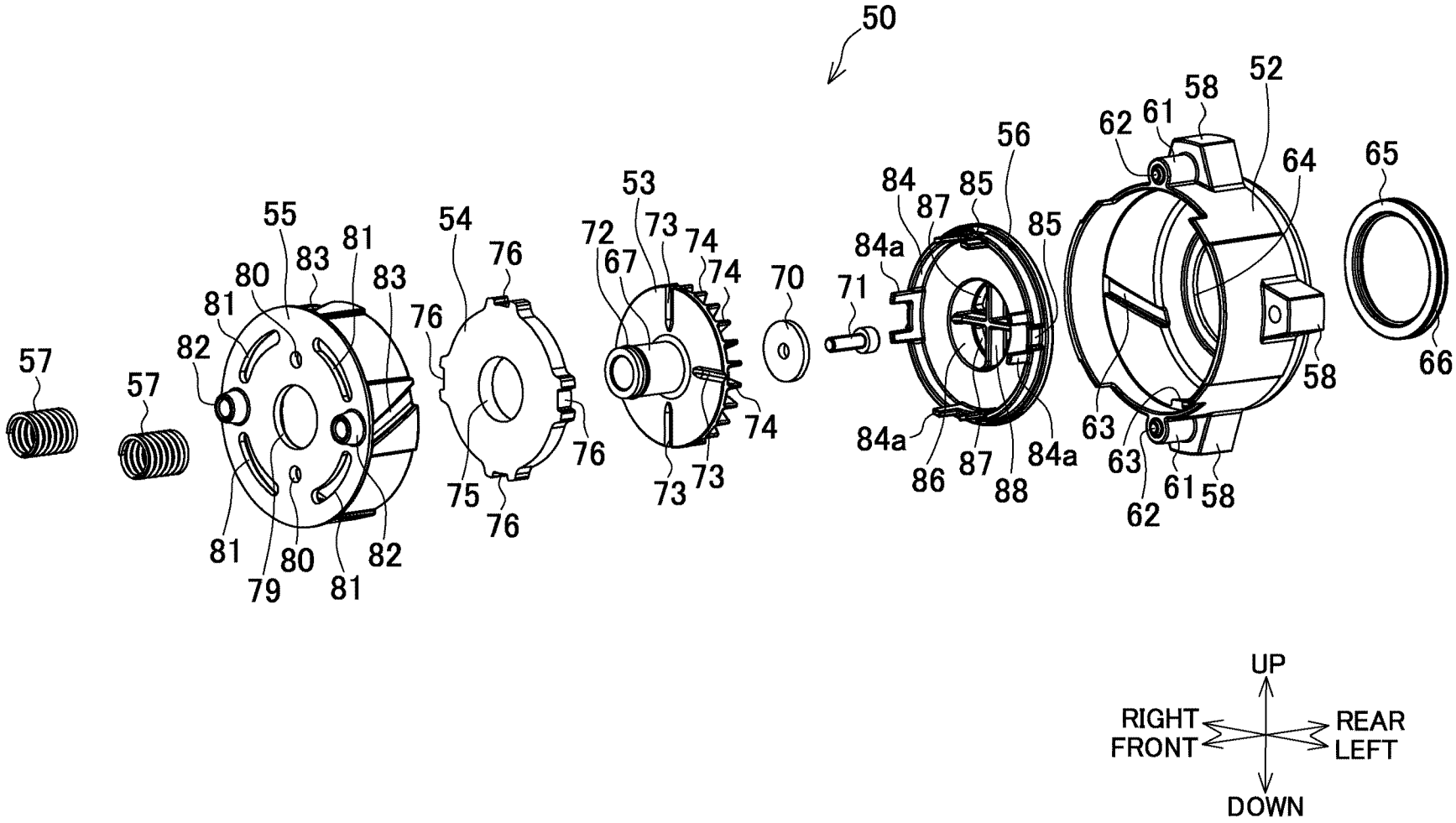
FIG. 7 is an exploded perspective view from a front of a brake portion.
Figure 8:
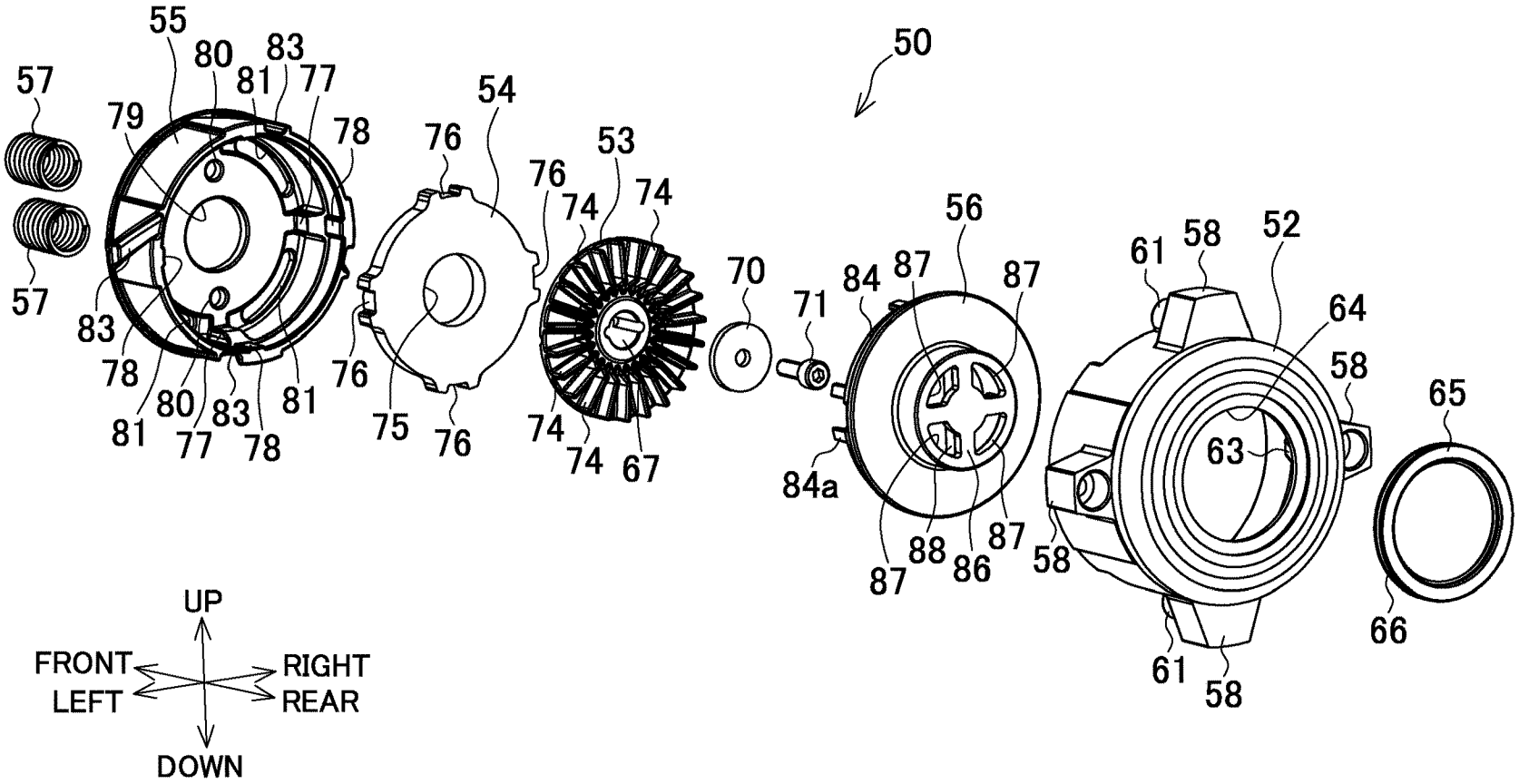
FIG. 8 is an exploded perspective view from a rear of the brake portion.
Figure 9:
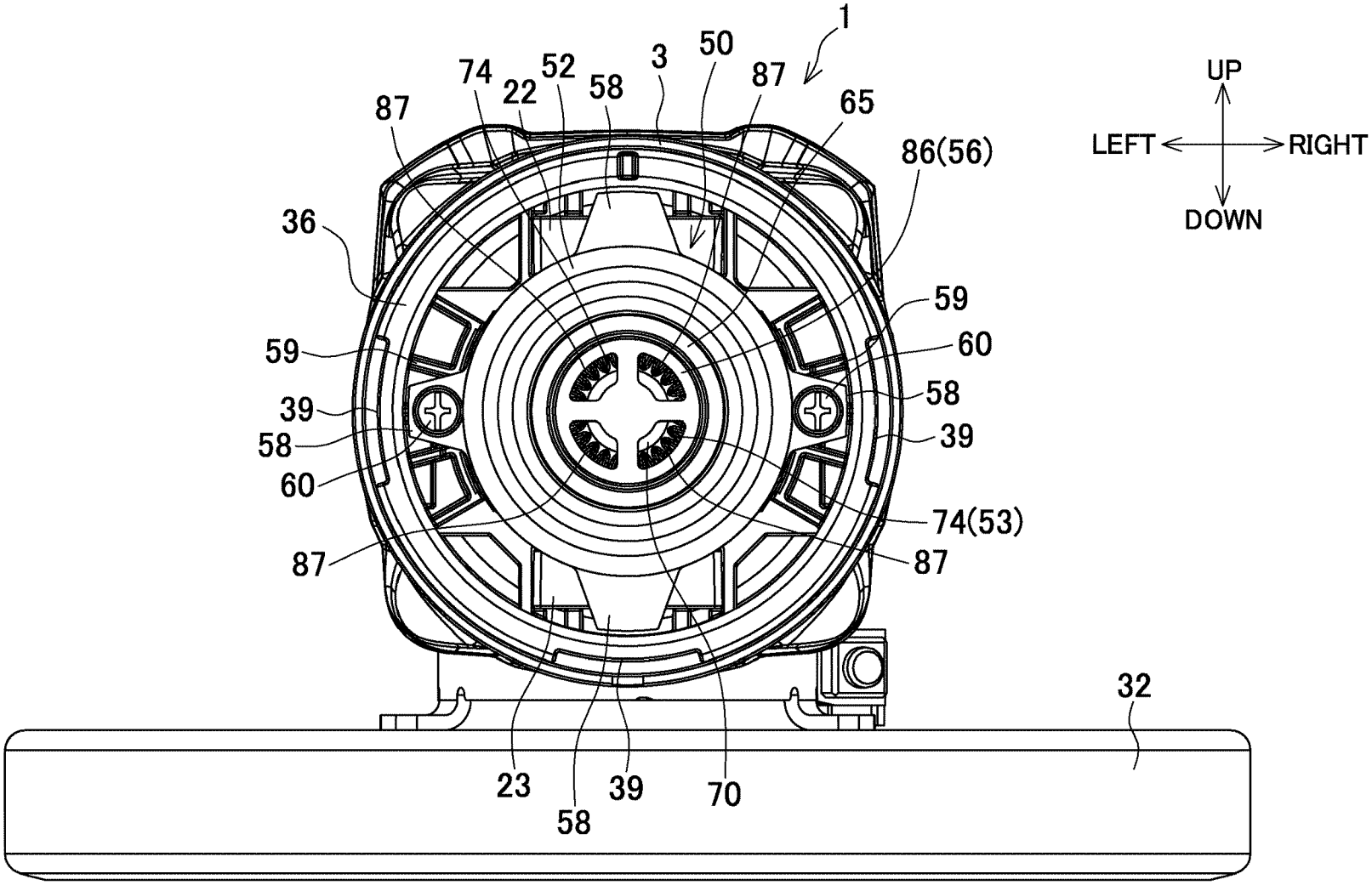
FIG. 9 is an explanatory drawing of a motor housing viewed from a rear in a state where the handle housing is omitted.

As illustrated in FIGS. 7, 8, the base 52 includes projecting pieces 58, 58 . . . projecting outward at four positions equally spaced in the circumferential direction on an outer peripheral surface. The projecting pieces 58, 58 at two positions on the right and the left among these are for securing the base 52, and are secured to extension pieces 59, 59 on the right and the left by screwing screws 60, 60 passed through from the rear as illustrated in FIG. 5 and FIG. 9. The extension pieces 59, 59 hold the bearing portion 13 inside the motor housing 3. Meanwhile, the projecting pieces 58, 58 at two positions on the top and the bottom integrally have boss portions 61, 61 each projecting forward. The boss portion 61 holds a column-shaped rubber pin 62. These rubber pins 62, 62 project forward from the boss portion 61, 61, and, as illustrated in FIG. 4, abut on respective rear surfaces of the upper and lower controllers 22, 23. Thus, the rubber pins 62, 62 reduce rattling of the upper and lower controllers 22, 23.

The base 52 has an inner peripheral surface on which four spiral ridges 63, 63 . . . are disposed to protrude at regular intervals in the circumferential direction. The spiral ridges 63, 63 . . . incline in a spiral pattern toward the same direction (here, a left side rotation direction toward the rear) with respect to an axial direction. The base 52 has a center in a bottom portion where an opening 64 with a diameter smaller than that of a front surface is formed. The opening 64 has a seal ring 65 mounted with a mounting groove 66 which is formed on the outer peripheral surface and fitted to an inner peripheral edge of the opening 64.

The brake plate 53 is made of a disk-shaped metal, and has a center on a front surface as a braking surface on which a cylindrical portion 67 is integrally formed. The cylindrical portion 67 extends forward. The cylindrical portion 67 is externally mounted on a coupling shaft 68 (for example, FIGS. 4, 5) which is coaxially disposed to extend at the rear end of the output shaft 12, passes through the bearing portion 13, and project rearward. The coupling shaft 68 and the cylindrical portion 67 are combined to be integrally rotatable with a pair of keys 69, 69 fitted to stride over the two from the rear. To stop the brake plate 53 from coming off rearward, a circular plate 70 in contact with a center of a rear surface of the brake plate 53 is secured with a bolt 71 threadably mounted on a center of the coupling shaft 68 from the rear. The cylindrical portion 67 has an outer periphery that is a portion passing through the bearing portion 13 on which an O-ring 72 for sealing is externally mounted.

The brake plate 53 has the front surface where a plurality of grooves 73, 73 . . . in the radial direction are formed at regular intervals in the circumferential direction. On the rear surface in a peripheral area of the circular plate 70, a plurality of fins 74, 74 . . . extending in the radial direction are integrally disposed upright at regular intervals in the circumferential direction.

The brake shoe 54 is in a disk-shape having a diameter approximately same as that of the brake plate 53, and has a center on which a through-hole 75 having a diameter larger than that of the cylindrical portion 67 of the brake plate 53 is formed. The cylindrical portion 67 is movably inserted into the through-hole 75. The brake shoe 54 has an outer peripheral surface on which engagement grooves 76, 76 . . . in the axial direction are formed at four positions at regular intervals in the circumferential direction. The engagement grooves 76, 76 . . . are formed by pairs of projections protrudingly disposed at predetermined intervals.

The shoe holder 55 is in a shape of a cylinder with a closed bottom inside which the brake shoe 54 is fittable, and has an inner peripheral surface on which engaging projections 77, 77 . . . in the axial direction are disposed to protrude at four positions at regular intervals in the circumferential direction toward the rear from the bottom portion side. The engaging projections 77, 77 . . . engage with the engagement grooves 76, 76 . . . of the brake shoe 54. The shoe holder 55 has a rear surface opening edge having a thickness formed thinner than that of the front side. On the thin walled portion and at the rear of each of the engaging projections 77, projections 78, 78 . . . are formed so as to be lower than the engaging projections 77.

The shoe holder 55 has the bottom portion on which a through hole 79 having a diameter larger than that of the cylindrical portion 67 of the brake plate 53 is formed. The cylindrical portion 67 is movably inserted into the through hole 79. Outside the through hole 79, two small holes 80, 80 are drilled at point symmetry positions centering the through hole 79 and four circular arc grooves 81, 81 . . . are concentrically drilled. Between the circular arc grooves 81, 81 having different phases from the small holes 80, 80, pairs of receiving projections 82, 82 are disposed to protrude forward.

Furthermore, the shoe holder 55 has an outer peripheral surface on which four thick wall portions are formed at the same phase as that of the engaging projections 77. The respective thick wall portions have surfaces on which four spiral grooves 83, 83 . . . are depressed at regular intervals in the circumferential direction. The spiral grooves 83, 83 . . . correspond to the spiral ridges 63 of the base 52 and incline in a spiral pattern in the same direction as that of the spiral ridges 63 with respect to the axial direction.

The cap 56 is in a disk-shape having an outer diameter slightly smaller than an outer diameter of the shoe holder 55, and has a front surface on which a spigot joint portion 84 that fits to the thin walled portion of the shoe holder 55 is formed. The spigot joint portion 84 has an outer peripheral surface on which locking grooves 85, 85 . . . that lock to the respective projections 78, 78 . . . of the shoe holder 55 are depressed in the front-rear direction. On inner sides of the respective locking grooves 85 and on an inner peripheral surface of the spigot joint portion 84, U-shaped stops 84*a* that engage with the engaging projections 77 of the shoe holder 55 are each disposed to protrude forward.

The cap 56 has a center on which a rear cylinder portion 86 with a small diameter is formed. The rear cylinder portion 86 passes through the opening 64 of the base 52 and projects toward the rear of the base 52. An outer peripheral surface of the rear cylinder portion 86 is brought into sliding contact with the seal ring 65. The rear cylinder portion 86 has a rear surface excluding the center on which four fan-shaped ventilation holes 87, 87 . . . are formed opening. The rear cylinder portion 86 has an inner portion in which a cross-shaped straightening vane 88 is disposed. The straightening vane 88 divides inside the rear cylinder portion 86 into four so as to correspond to the ventilation holes 87.

The coil springs 57, 57 have rear ends held by being fitted to the receiving projections 82, 82 on the front surface of the shoe holder 55, and have front ends held onto receiving depressed portions 89, 89 formed on the right and left extension pieces 59, 59 outside the bearing portion 13 as illustrated in FIG. 5. Thus, the coil springs 57, 57 are arranged at positions having phases 90 degrees different from phases of the upper and lower controllers 22, 23, and overlap the bearing portion 13 in the radial direction. Thus, even though the brake portion 50 is disposed at the rear portion of the rotor 11, a dimension in the axial direction can be reduced to compact.

In the brake portion 50, the brake shoe 54 is pushed in to a front side bottom portion inside the shoe holder 55 with the engagement grooves 76 engaging with the respective engaging projections 77 of the shoe holder 55. Then, the brake plate 53 is housed from the rear of the brake shoe 54 by the cylindrical portion 67 being movably inserted into the through-hole 75 of the brake shoe 54 and the through hole 79 of the shoe holder 55. Next, in a state where the coil springs 57, 57 are interposed between the receiving projections 82, 82 of the shoe holder 55 and the receiving depressed portions 89, 89 of the extension pieces 59, 59, the cylindrical portion 67 is joined to the coupling shaft 68 with the keys 69 and is secured with the circular plate 70 and the bolt 71.

Figure 10B:
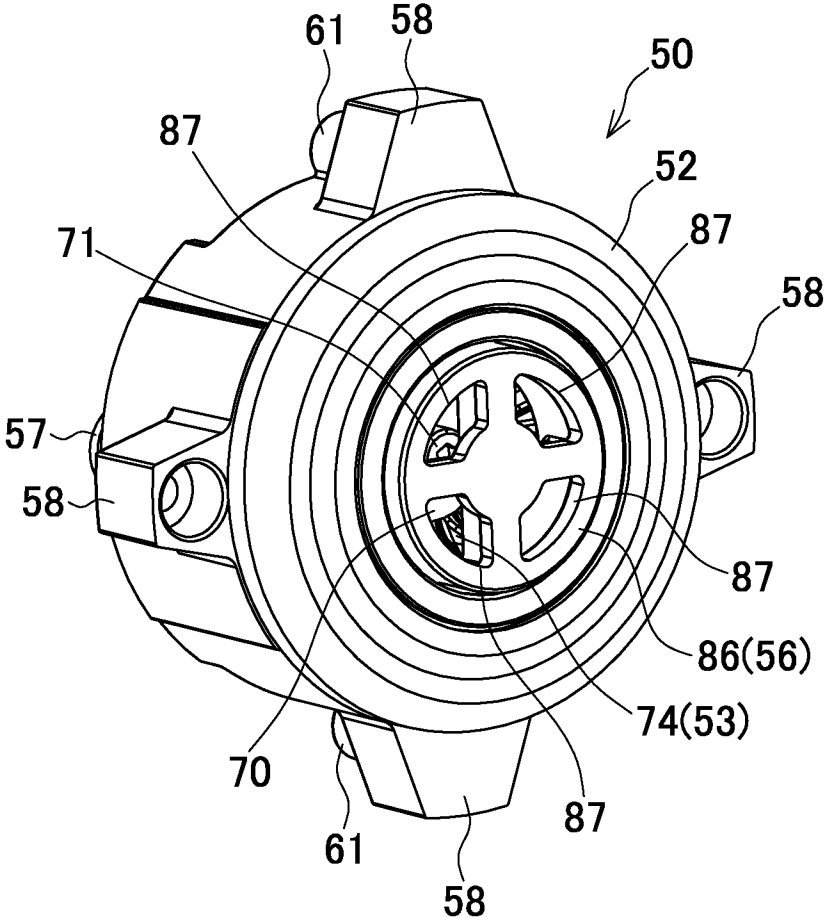
FIG. 10B is an explanatory drawing illustrating an assembled state of the brake portion, which is a perspective view from a rear.
Figure 10A:
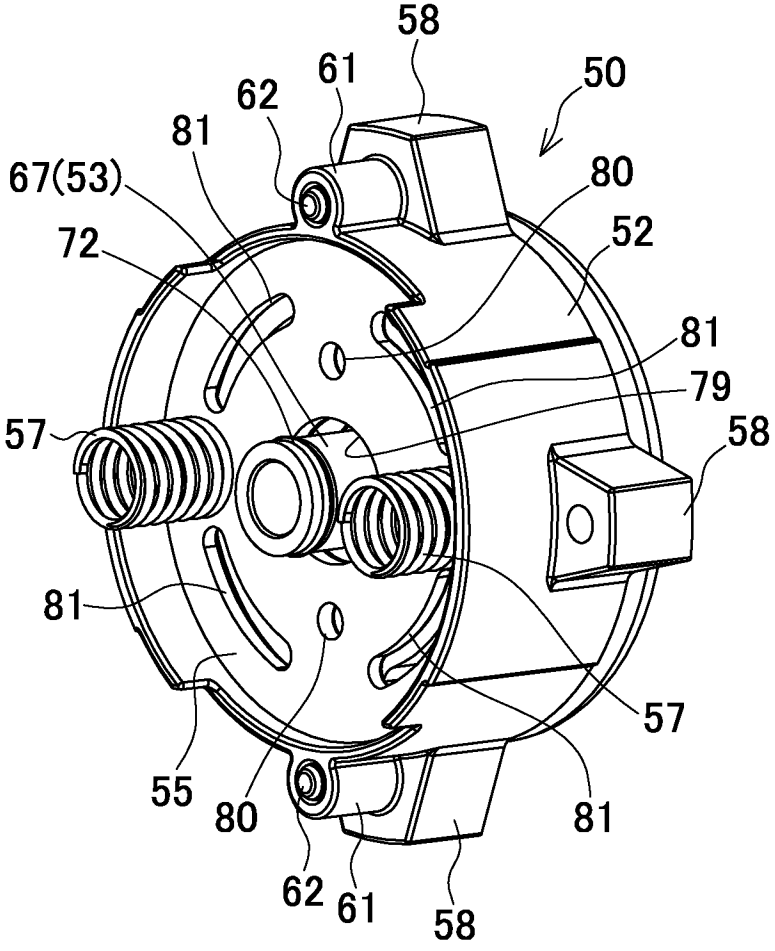
FIG. 10A is an explanatory drawing illustrating an assembled state of the brake portion, which is a perspective view from a front.
Figure 11:
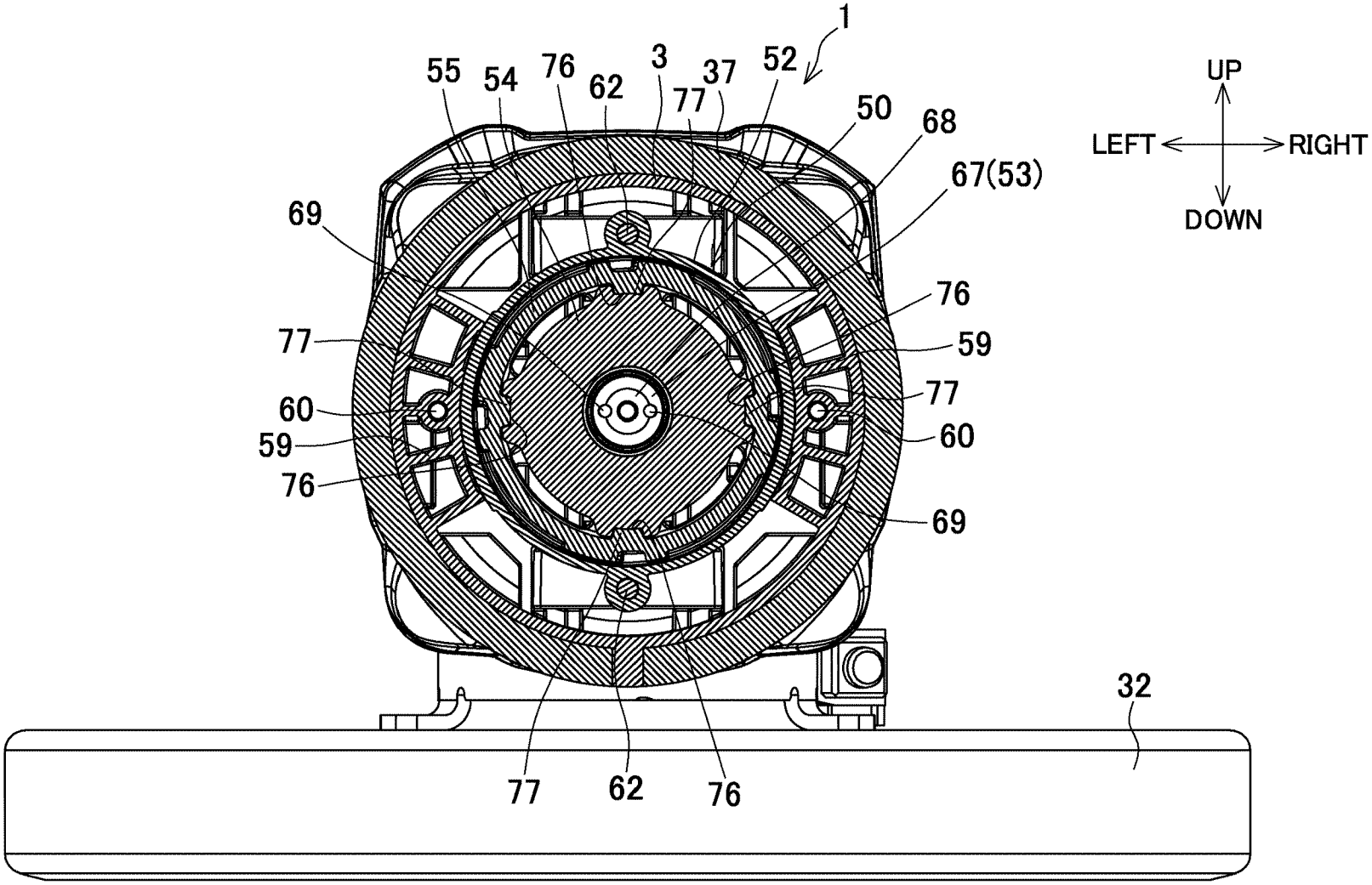
FIG. 11 is an enlarged cross-sectional view taken along a line B-B in FIG. 2.
Figure 12:
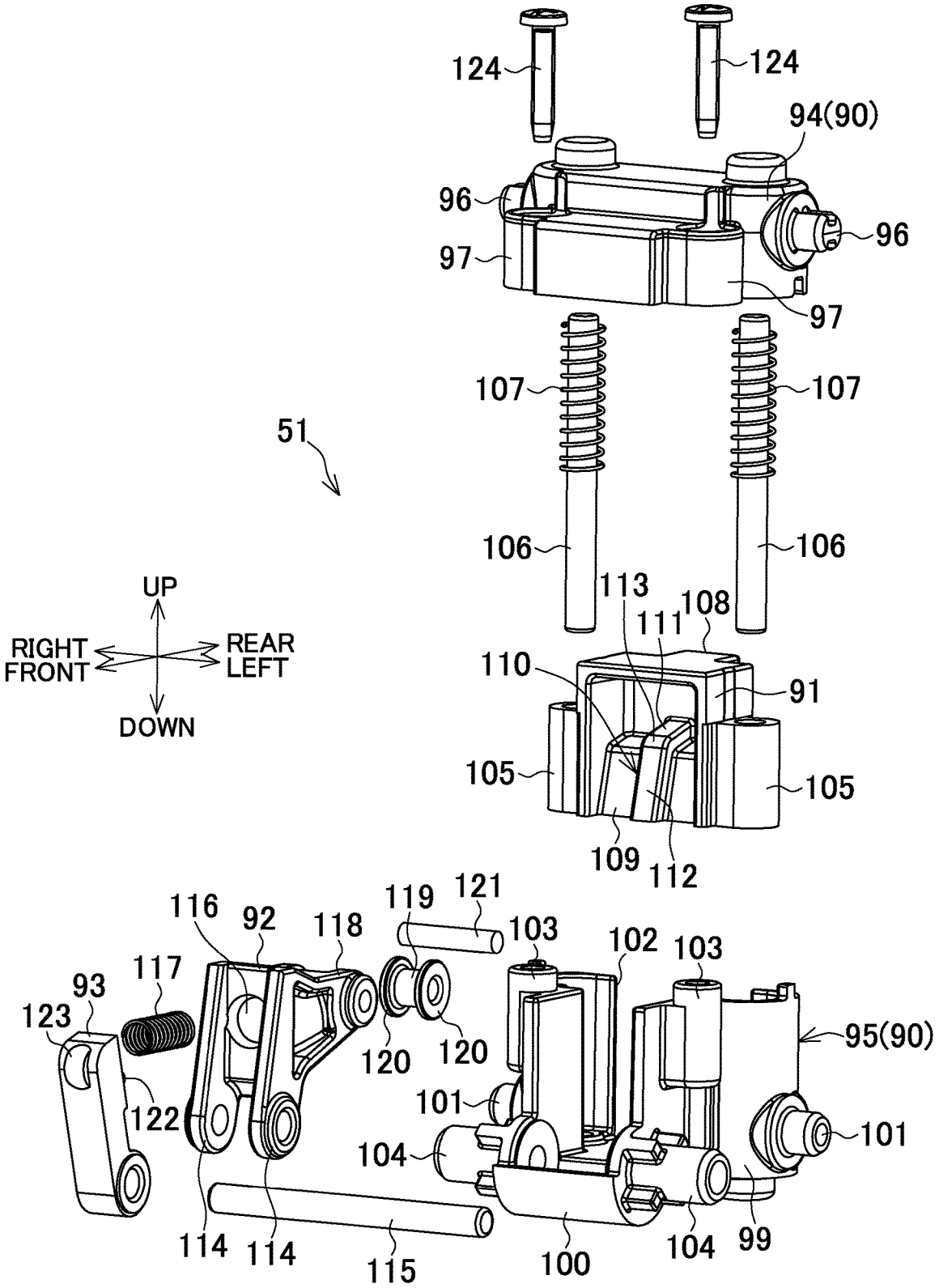
FIG. 12 is an exploded perspective view from a front of a linking unit.

Then, the cap 56 is put on the shoe holder 55 from the rear such that the locking grooves 85 are locked to the respective projections 78 and the stops 84*a* are engaged with the respective engaging projections 77. The base 52 is assembled to the outside from the rear of the shoe holder 55 with the spiral grooves 83 being fitted to the respective spiral ridges 63. At last, screwing the projecting pieces 58, 58 of the base 52 to the extension pieces 59, 59, as illustrated in FIGS. 9 to 11, completes the assemble of the brake portion 50. However, FIGS. 10A and 10B illustrate only the unitized brake portion 50 alone.

In this assembled state, as illustrated in FIGS. 4, 5, the shoe holder 55 and the cap 56 rotatingly retreat guided by the spiral ridges 63 with the coil springs 57, 57, and are biased at a retreated position (brake position) where the brake shoe 54 is pressed to the front surface of the brake plate 53. Accordingly, the output shaft 12 is braked via the brake plate 53 and the coupling shaft 68 integrated with this. The rear cylinder portion 86 of the cap 56 projects rearward from the opening 64 of the base 52 at this brake position.

Next, the linking unit 51 includes, as illustrated in FIG. 12 to FIG. 14B, a holding case 90, a slide body 91, a swing lever 92, and a press lever 93. The slide body 91 is held movable up and down inside the holding case 90. The swing lever 92 has a lower end supported by the holding case 90 and swings back and forth corresponding to the up and down motion of the slide body 91. The press lever 93 similarly has a lower end supported by the holding case 90 and presses the cap 56. The swing lever 92 and the press lever 93 form a conversion member.

Figure 13A:
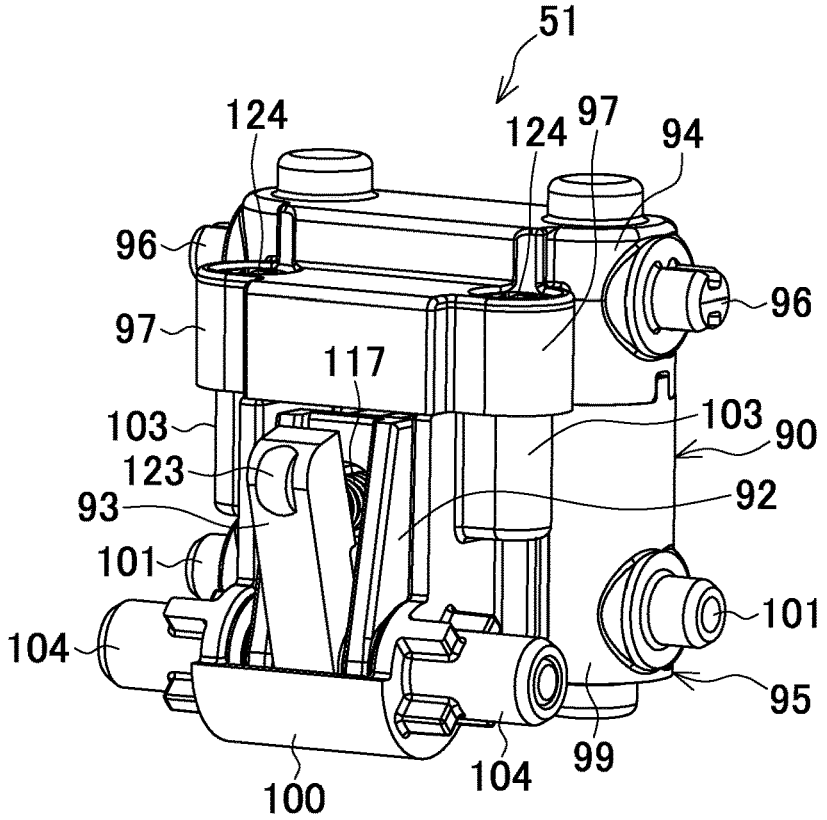
FIG. 13A is an explanatory drawing of the linking unit, which is a perspective view from the front.
Figure 13B:
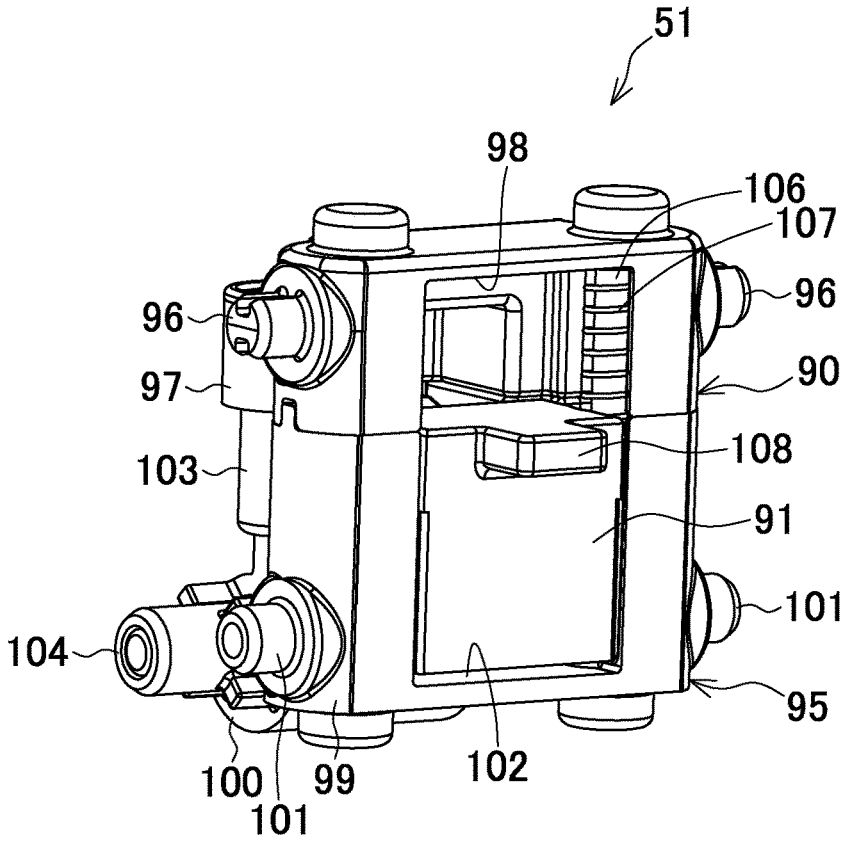
FIG. 13B is an explanatory drawing of the linking unit, which is a perspective view from the rear.
Figure 14A:
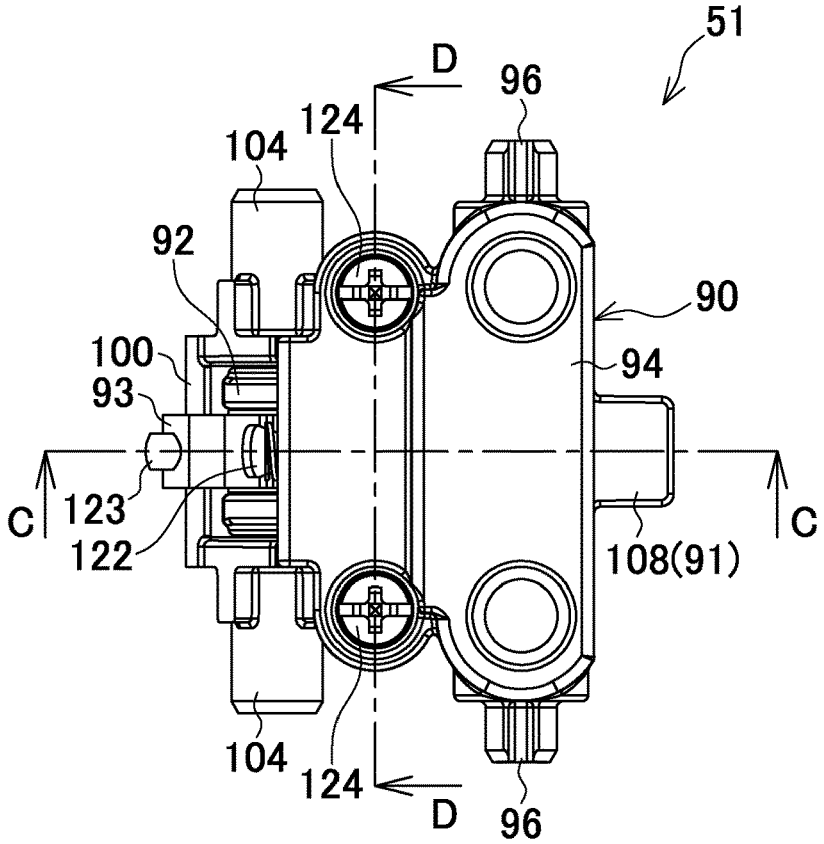
FIG. 14A is an explanatory drawing of the linking unit, which is a planar surface.
Figure 14B:
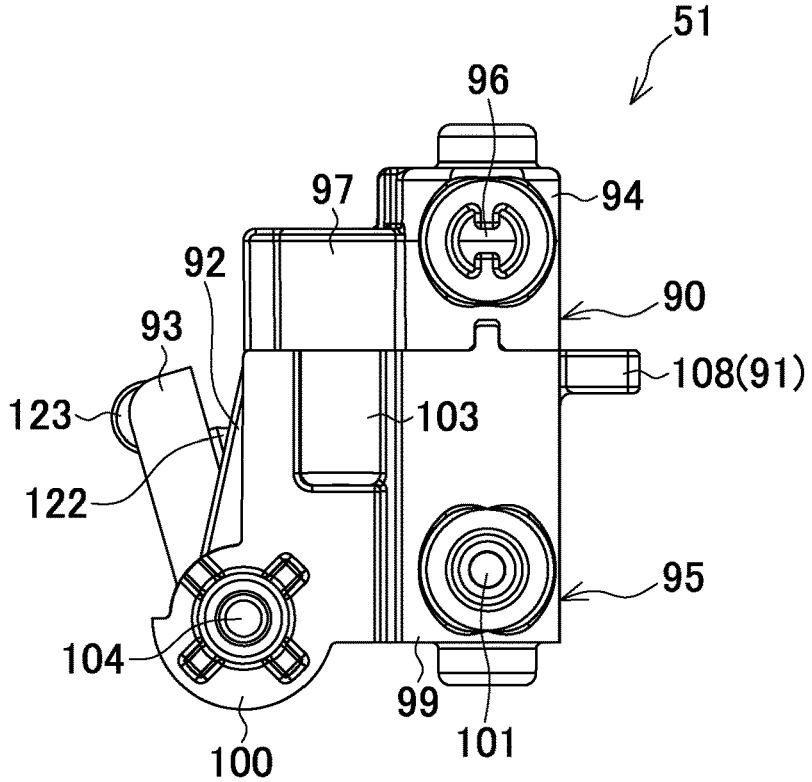
FIG. 14B is an explanatory drawing of the linking unit, which is a side surface.

First, the holding case 90 are divided into two of an upper case 94 and a lower case 95. The upper case 94 is in a horizontally long cap-shape with a lower surface opened. The upper case 94 has right and left side surfaces on which upper bosses 96, 96 coaxial in the right-left direction are each disposed to protrude. At right and left on a front surface, upper cylinders 97, 97 for screwing are formed, and on a rear surface, as illustrated in FIGS. 13A and 13B, an upper cutout 98 in a square shape is formed facing down.

The lower case 95 is in a T-shape in plan view. The lower case 95 is formed of a horizontally long cap portion 99 and a receiving portion 100 in the front-rear direction. The cap portion 99 has an upper surface opened and fits to the upper case 94. The receiving portion 100 projects forward from a front side center of the cap portion 99 and has an upper surface opened. The cap portion 99 has right and left side surfaces on which lower bosses 101, 101 are each disposed to protrude coaxially in the right-left direction. The lower bosses 101, 101 are located immediately under the upper bosses 96, 96 in a fitted state with the upper case 94. The cap portion 99 has the rear surface on which a lower cutout 102 is formed facing up. The lower cutout 102 is in a square shape continuous with the upper cutout 98 in the fitted state with the upper case 94.

At right and left toward the rear of the receiving portion 100, screw bosses 103, 103 are formed to be located immediately under the upper cylinders 97, 97 in the fitted state with the upper case 94. On right and left side surfaces in the front end of the receiving portion 100, front bosses 104, 104 coaxial in the right-left direction are each disposed to protrude.

Figure 15A:
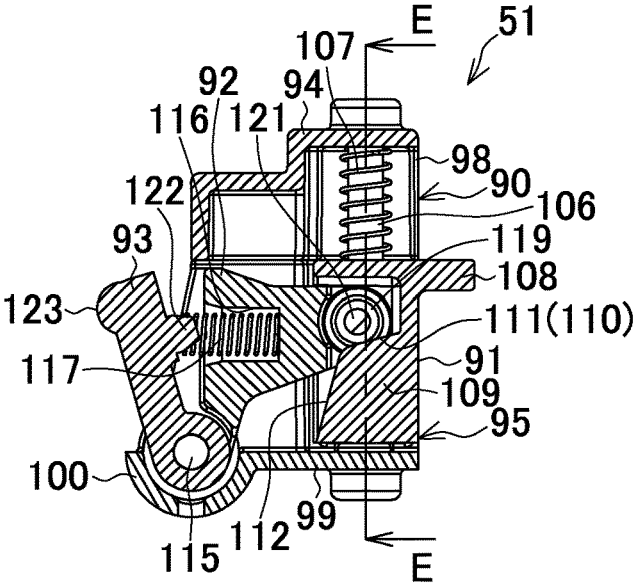
FIG. 15A illustrates a cross-sectional surface taken along a line C-C in FIG. 14.
Figure 15B:
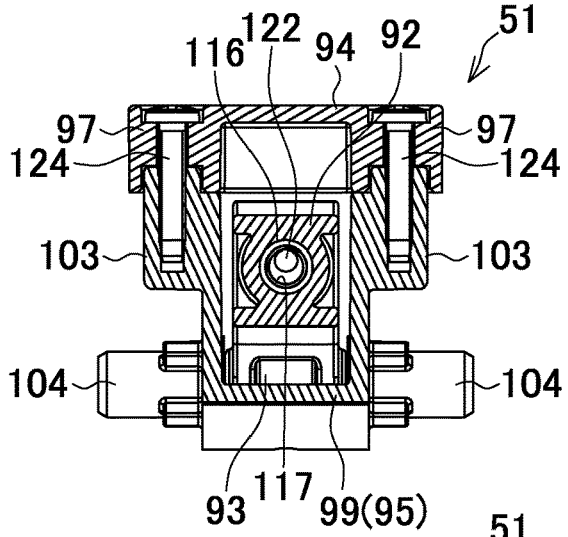
FIG. 15B illustrates a cross-sectional surface taken along a line D-D in FIG. 14.
Figure 15C:
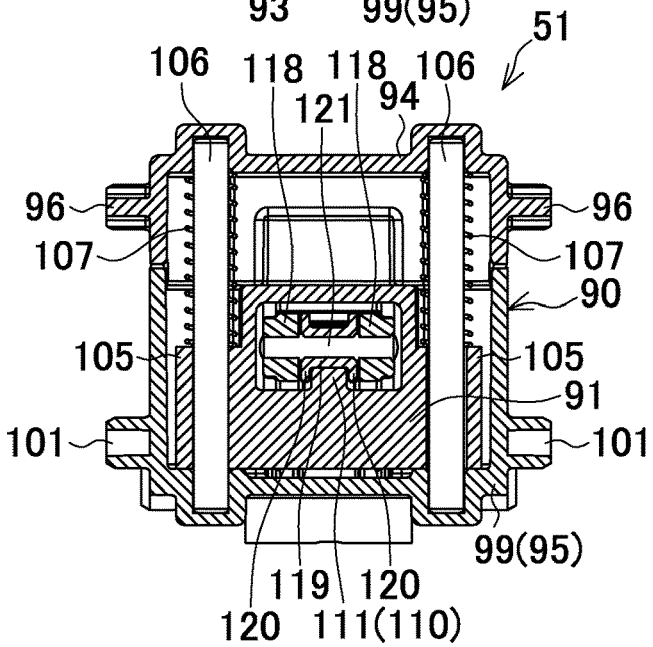
FIG. 15C illustrates a cross-sectional surface taken along a line E-E in FIG. 15A.

The slide body 91 is a block body in a square shape in front view, and has right and left side surfaces on which guide cylinders 105, 105 are integrally formed in the up and down direction. These guide cylinders 105, 105 are passed through by a right and left pair of guide shafts 106, 106 held in the up and down direction between the upper case 94 and the cap portion 99 of the lower case 95. These guide shafts 106, 106 hold the slide body 91 movable up and down in the holding case 90. On the guide shafts 106, 106, coil springs 107, 107 are externally mounted and abut on the upper case 94 and the slide body 91. Therefore, the slide body 91 in an ordinary state is biased at a lower limit position where it abuts a bottom portion of the cap portion 99 as illustrated in FIGS. 15A to 15C.

The slide body 91 has an upper end rear surface on which a linking piece 108 is disposed to protrude toward the rear. The linking piece 108 projects rearward from the opening formed by the upper cutout 98 and the lower cutout 102 of the upper and lower cases 94, 95.

Figure 16B:
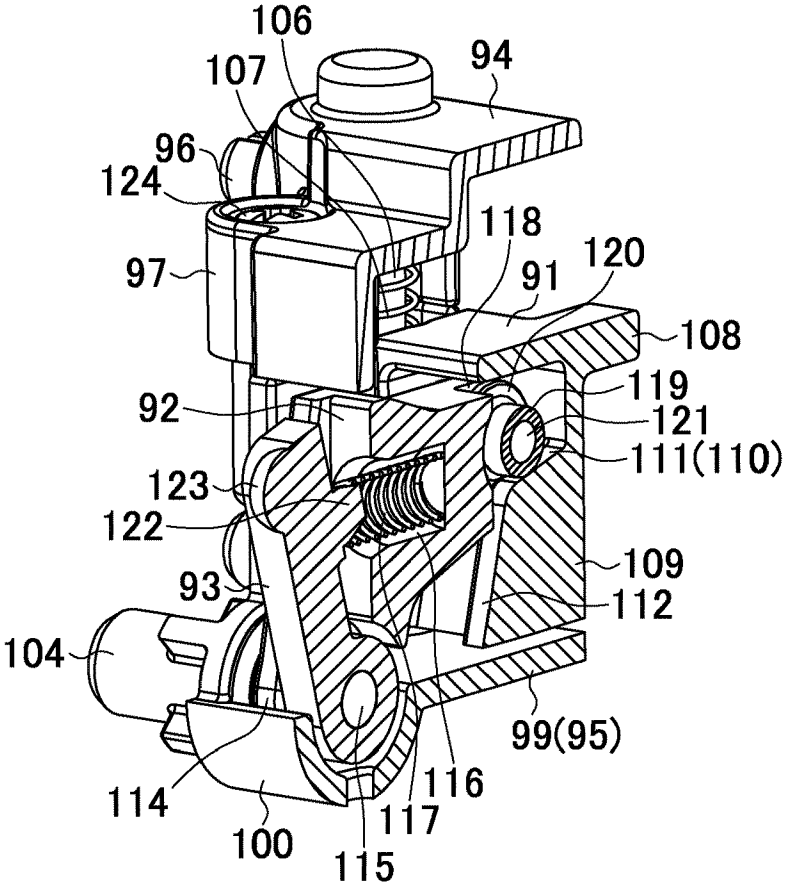
FIG. 16B is a perspective view of a center vertical cross-sectional surface of the linking unit.
Figure 16A:
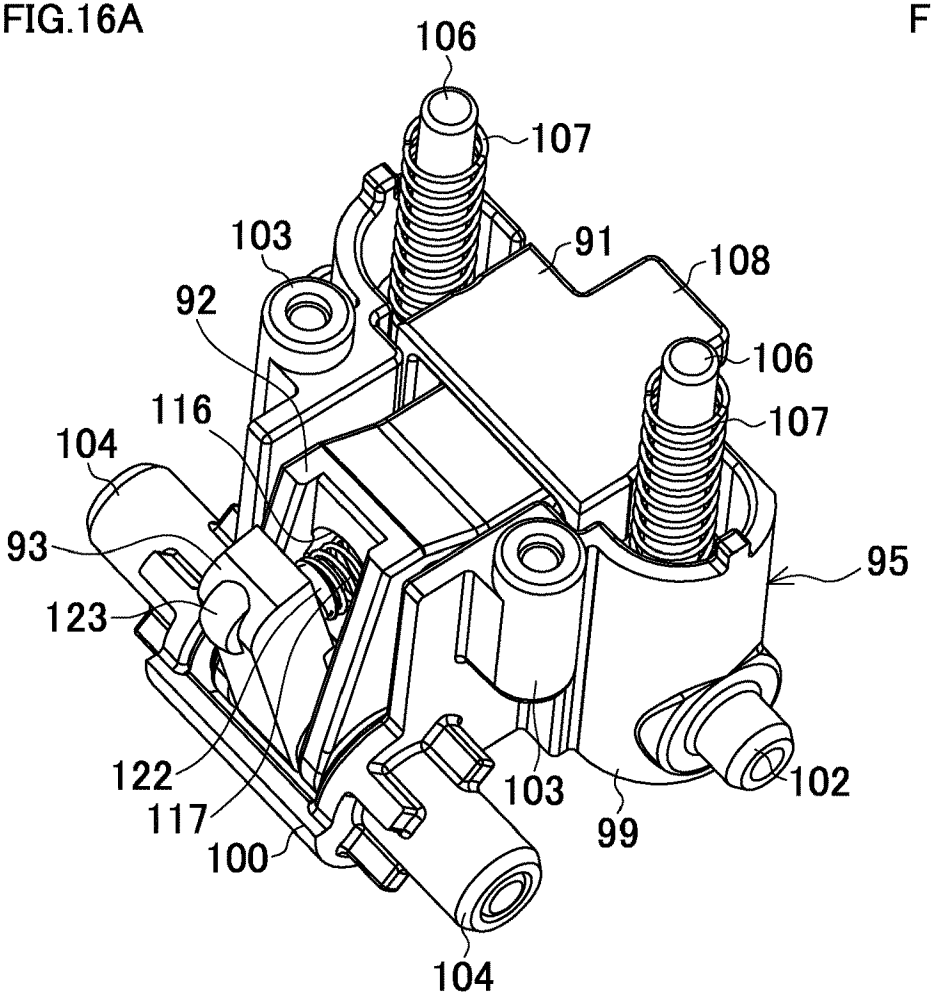
FIG. 16A is a perspective view from an upper side of the linking unit from which an upper case is omitted.

Furthermore, the slide body 91 has a front surface on which a depressed portion depressed rearward is formed. On a lower portion inside the depressed portion, a stepped portion 109 is formed. The stepped portion 109 has an upper surface and a front surface being forwardly descending inclined surfaces. The front surface has an inclination angle larger than that of the upper surface. The stepped portion 109 has a center in the right-left direction where a guide rail 110 is formed. The guide rail 110 has an upper guide surface 111 and a lower guide surface 112 as illustrated in FIG. 16B. The upper guide surface 111 projects upward with respect to the upper surface of the stepped portion 109 and inclines forwardly descending at a large angle with respect to the up and down direction. The lower guide surface 112 projects forward with respect to the front surface of the stepped portion 109 and inclines forwardly descending at a small angle with respect to the up and down direction. A corner portion between the upper guide surface 111 and the lower guide surface 112 is a curved surface 113 continuously connecting the upper and lower guide surfaces 111, 112.

The swing lever 92 presents an inverted L-shape in side view, and has a lower end portion where a right and left pair of coupling pieces 114, 114 are disposed to protrude. The coupling piece 114 is positioned inside the front end of the receiving portion 100, and is rotatably coupled by a coupling pin 115 that coaxially passes through the front bosses 104, 104. In view of this, the swing lever 92 is supported swingably back and forth about the coupling pin 115 on the lower case 95. The swing lever 92 has an upper side front surface where a closed-end hole 116 opening forward is formed, and a coil spring 117 is housed in here.

Furthermore, the swing lever 92 has a rear end portion on which a right and left pair of holding pieces 118, 118 are disposed to protrude. Between the holding pieces 118, 118, a roller 119 with flanges 120, 120 at both ends is rotatably held by a pin 121. The roller 119 abuts on a peripheral surface of the guide rail 110 by positioning the guide rail 110 of the slide body 91 between the flanges 120, 120. The roller 119 relatively rolls along the guide rail 110 in association with the up and down motion of the slide body 91 to swing the swing lever 92.

The press lever 93 is a rod-shaped body having a lower end disposed between the coupling pieces 114, 114 of the swing lever 92 and coupled with the coupling pin 115, so that the press lever 93 is swingable back and forth. The press lever 93 has an upper portion rear surface on which a small boss 122 having a tapered off shape toward the rear is formed. The small boss 122 is fitted to a front end of the coil spring 117 held in the swing lever 92. Accordingly, the swing lever 92 and the press lever 93 are each biased to the front-rear direction (the swing lever 92 rearward and the press lever 93 forward) opposing one another by the coil spring 117.

The press lever 93 has a front surface upper portion on which a spherical surface shaped projection 123 is disposed to protrude forward.

Thus, the upper and lower cases 94, 95, in which the slide body 91 and the swing lever 92, and the press lever 93 are each assembled to be movable up and down or swingable back and forth, are assembled with the screws 124, 124 at the positions of the upper cylinders 97, 97 and the screw bosses 103, 103. Accordingly, it is possible to obtain the single linking unit 51 in which the swing lever 92 swings in conjunction with the up and down motion of the slide body 91 inside the holding case 90, and the press lever 93 swings in conjunction with the swing of the swing lever 92. The linking unit 51 is supported between the brake portion 50 and the switch lever 43 by fitting each of support bosses 125, 125 . . . to the upper and lower bosses 96, 101 and the front bosses 104 of the holding case 90, as illustrated in FIG. 5, inside the handle housing 7. The support bosses 125, 125 . . . are disposed to protrude in opposing manner from the inner surface of the right and left half housings 7*a*, 7*b*

As described above, since the linking mechanism is unitized as the linking unit 51, assemblability is improved. Further, even though operation members, such as the slide body 91, the swing lever 92, and the press lever 93, are provided, exposed portions to the outside are reduced, thereby eliminating a possibility of wiring damages caused by a contact to wiring inside the handle housing 7.

In this state, the linking piece 108 of the slide body 91 locks to a cutout 126 (FIGS. 4, 6) disposed at a front end of the switch lever 43 from above, and, at the lower limit position of the slide body 91, the switch lever 43 is also at a swing position (OFF position of the switch 9) to the lower side. At the lower limit position of the slide body 91, the swing lever 92 biased rearward by the coil spring 117 is at a rear side swing position where the roller 119 abuts on the upper guide surface 111 of the guide rail 110 of the slide body 91, and the press lever 93 biased forward by the coil spring 117 is biased at a position where the spherical surface shaped projection 123 abuts on the center of the rear cylinder portion 86 of the cap 56. The press lever 93 thus abutting on the cap 56 via the coil spring 117 ensures absorbing a displacement even though the handle housing 7 relatively moves with respect to the motor housing 3, thereby ensuring constantly pressing the cap 56. The abutting portion of the press lever 93 corresponds to a rotation center of the handle housing 7, thereby ensuring constantly pressing the center of the cap 56 even though the handle housing 7 rotates.

In the grinder 1 configured as described above, the brake mechanism 8 with the switch 9 in the OFF state has the brake shoe 54 pressing onto the brake plate 53 whose rotation is integral with the output shaft 12 as described above, thereby applying a brake.

Figure 17:
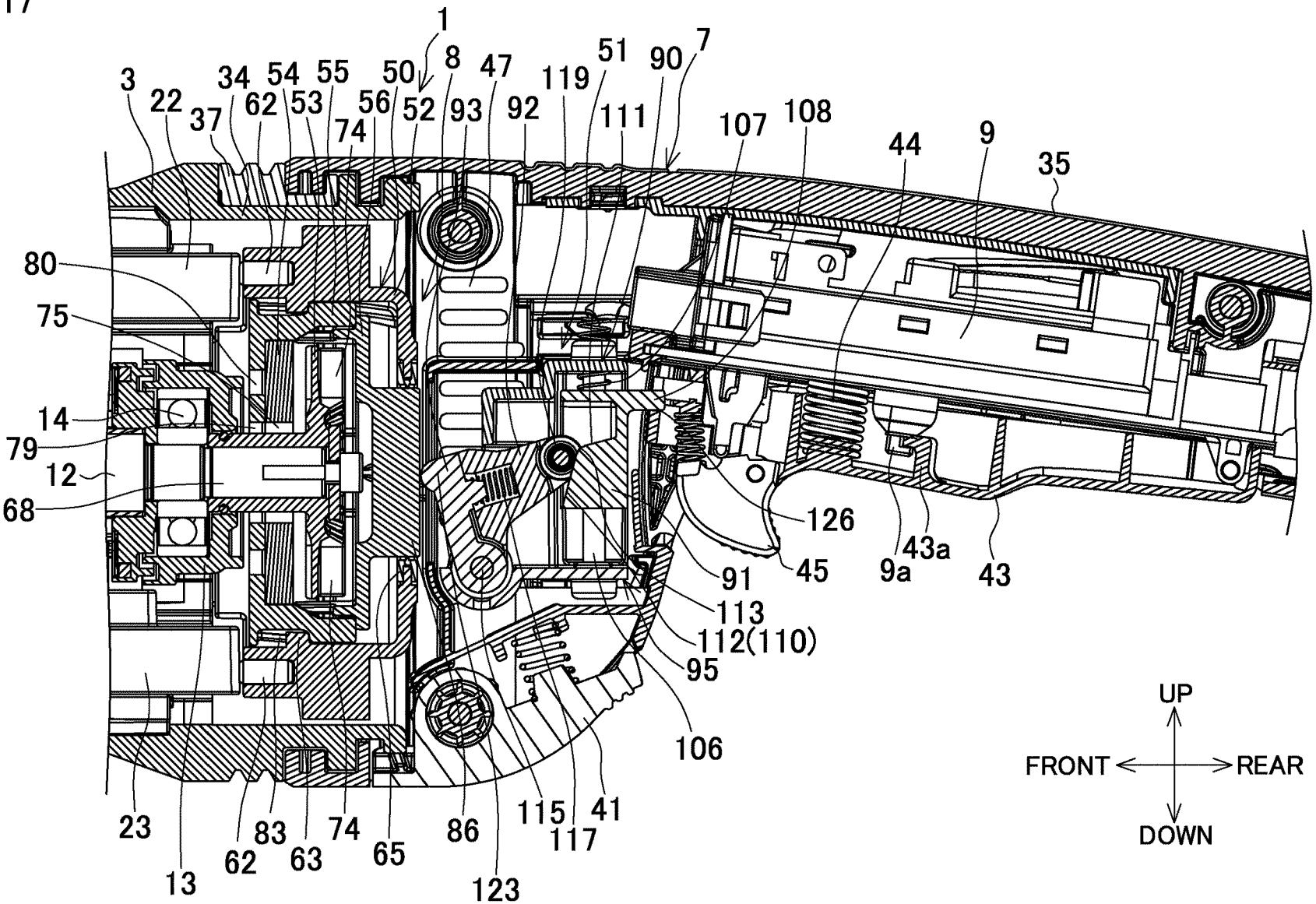

When a lock off by the lock lever 45 is released and push-in operation of the switch lever 43 is performed, the front end of the switch lever 43 pushes up the slide body 91 of the linking unit 51 upward via the linking piece 108 along the guide shafts 106, 106 resisting against the biasing of the coil springs 107, 107 from the lower limit position as illustrated in FIG. 17. Then, the roller 119 of the swing lever 92 relatively rolls forward on the guide rail 110. Thus, the swing lever 92 swings forward and abuts on the press lever 93. Therefore, the press lever 93 is pressed forward to move the cap 56 and the shoe holder 55 resisting against the biasing of the coil springs 57, 57. The movement of the cap 56 and the shoe holder 55 is rotatingly performed by the guide of the spiral ridge 63 and the spiral groove 83.

Accordingly, the brake shoe 54 moves forward together with the shoe holder 55 to move to the advance position (brake release position) where the brake shoe 54 separates from the brake plate 53, and therefore, the braking of the output shaft 12 via the coupling shaft 68 is released.

Meanwhile, the push-in operation of the switch lever 43 pushes in the plunger 9*a* to operate the switch 9 ON, therefore, the motor 4 is driven to rotate the output shaft 12 whose braking is released together with the rotor 11. Accordingly, the rotation is transmitted to the spindle 24 via the bevel gears 17, 25 to rotate the disk-shaped grinding wheel 31.

The guide rail 110 of the slide body 91 has the upper guide surface 111 having the large inclination angle with respect to the up and down direction and the lower guide surface 112 having the small inclination angle. Therefore, at an initial stage of the push-in operation of the switch lever 43, the elevating upper guide surface 111 significantly moves (rotational movement about the coupling pin 115) the roller 119 upward and forward to quickly swing the swing lever 92 and the press lever 93 forward. Accordingly, the push-in force in the upward direction of the switch lever 43 can be efficiently converted into the push-in force in the forward direction of the shoe holder 55, thereby ensuring quickly separating the brake shoe 54 from the brake plate 53. At the timing where the roller 119 goes over the curved surface 113 to relatively move to the lower guide surface 112 from the upper guide surface 111, the switch 9 is turned ON.

After the switch 9 is turned ON, the push-in of the switch lever 43 is not restricted, and there is disposed a slight amount of margin (backlash) to allow the push-in of the switch lever 43. Accordingly, when the push-in of the switch lever 43 is continued, the roller 119 rolls on the lower guide surface 112 with the small inclination angle with respect to the up and down direction. Therefore, the amount of movement upward and forward here decreases to slow a forward swing velocity of the swing lever 92 and the press lever 93.

At this time, a repulsion force from the coil springs 57, 57 caused by pushing in the shoe holder 55 is applied to the lower guide surface 112 from the front via the roller 119 from the press lever 93 and the swing lever 92, thereby being transmitted to the guide shafts 106, 106 that support the slide body 91. Accordingly, the resistance at the push-in of the switch lever 43 is caused by the coil springs 107, 107 that mainly bias the slide body 91, and thus, the push-in force of the switch lever 43 after the ON operation of the switch 9 is relatively reduced. Therefore, a reduced load is ensured when the push-in is maintained.

Meanwhile, when the rotation of the output shaft 12 rotates the centrifugal fan 18, the external air is suctioned into the handle housing 7 from the air inlet 47 of the handle housing 7. Then, the external air passes through the straightening vane 88 from the ventilation hole 87 of the cap 56, enters inside the shoe holder 55, and meanders to a front surface side passing through an outer periphery from the rear surface of the brake plate 53. Afterwards, the external air passes through the through-hole 75 of the brake shoe 54 and the through hole 79 and the circular arc grooves 81 of the shoe holder 55 from between the brake plate 53 and the brake shoe 54 to be discharged toward the front of the shoe holder 55. After the external air passes between the stator 10 and the rotor 11 from between the upper and lower controllers 22, 23 in a peripheral area of the bearing portion 13, the external air reaches inside the gear housing 5 via the partition plate 15 from the baffle plate 19 to be discharged from the exhaust outlet 33. This airflow cools the brake portion 50, the upper and lower controllers 22, 23, and the motor 4.

On the rear surface of the brake plate 53, the fins 74, 74 . . . are radially formed, therefore, they function as the centrifugal fan that generates an airflow by the rotation of the brake plate 53 inside the shoe holder 55. Accordingly, together with the airflow by the centrifugal fan 18, a further high cooling effect is provided.

Releasing the push-in operation of the switch lever 43 causes the slide body 91 to slide to the lower limit position to release the push-in of the plunger 9*a* to operate the switch 9 OFF. Afterwards, the roller 119 relatively moves to the upper guide surface 111 from the lower guide surface 112 of the guide rail 110 to swing the swing lever 92 rearward, thereby reducing the pressing force of the cap 56 by the press lever 93. Accordingly, the shoe holder 55 retreats by the biasing of the coil springs 57, 57, and returns to the retreated position (brake position) where the brake shoe 54 abuts on the brake plate 53. At this time, the roller 119 that rolls on the upper guide surface 111 significantly moves the swing lever 92 with respect to the downward sliding of the slide body 91, therefore, the retreat of the brake shoe 54 is quickly performed.

Since the brake is thus applied to the output shaft 12 via the brake plate 53 and the coupling shaft 68, the braking force is transmitted to the spindle 24, thereby immediately stopping the disk-shaped grinding wheel 31.

At this time, the shoe holder 55 abuts on the brake plate 53 by rotatingly retreats in the same direction as the rotation direction of the brake plate 53 by the guide of the spiral ridge 63 and the spiral groove 83, thereby giving effective braking force to the brake plate 53.

While, when the shoe holder 55 and the cap 56 return to the brake position, a load is applied to the slide body 91 from the front from the press lever 93 and the swing lever 92. The load applied to the slide body 91 is loaded on the guide shafts 106, 106 supporting the slide body 91, and is not transmitted to the switch lever 43.

When the push-in operation of the switch lever 43 and its release are repeated to intermittently use the grinder 1, the brake shoe 54 is pressed against the brake plate 53 that inertially rotates at braking, and thus, the brake plate 53 generates heat. However, since the brake plate 53 includes the fins 74, 74 . . . , the airflow generated by the centrifugal fan 18 contacts the fin 74 during the rotation, and moreover, even during the rotation stop, the air constantly contacts the fin 74. Therefore, the heat of the brake plate 53 is effectively radiated via the fin 74. As described above, the fins 74 are radially formed to function as the centrifugal fan, thereby ensuring a cooling effect also by the airflow generated by themselves.

Since the brake portion 50 is arranged in the rear portion of the rotor 11, the fresh (same temperature as the external temperature) air suctioned from the air inlet 47 can effectively cool the brake plate 53, compared with the case where the brake portion 50 is arranged in the front of the rotor 11 and is to be cooled by the high temperature air after cooling the motor 4.

Furthermore, even though the air flow is passed through the brake portion 50, the linking unit 51 is covered with the holding case 90, and in the brake portion 50, the seal ring 65 is interposed between the base 52 and the cap 56 of the shoe holder 55. Therefore, a dust-proof is ensured, and thus, there is no possibility of deterioration of the operation of the brake mechanism 8 due to dust and the like.

With the grinder 1 in the above-described configuration, the brake plate 53 includes the fins 74, and thus, the heat radiation effect can be obtained. Accordingly, the heat generation at braking is reduced to ensure reducing degradations of brake characteristics and component service life.

In particular, the brake mechanism 8 includes the cylinder-shaped shoe holder 55 that holds the brake shoe 54 that brakes by abutting on the brake plate 53, the cylinder-shaped base 52 that holds the shoe holder 55 movable forward and rearward with respect to the brake plate 53, and the coil springs 57, 57 that biases the shoe holder 55 to the brake plate 53 side. On the outer peripheral surface of the shoe holder 55, the plurality of spiral grooves 83 that inclines with respect to the axial direction of the shoe holder 55 are formed, and on the inner peripheral surface of the base 52, the spiral ridges 63 that fit to the spiral grooves 83 are formed. The shoe holder 55, while rotating in the same direction by the guide of the spiral grooves 83 and the spiral ridges 63, brings the brake shoe 54 into contact with the brake plate 53 when the shoe holder 55 moves to the brake plate 53 side. Thus, the pressing force in the axial direction acts to increase the braking force when the brake shoe 54 is brought into contact with the brake plate 53.

The brake mechanism 8 includes the linking unit 51 that links with the movement of the switch lever 43 to move the shoe holder 55 forward and rearward between the switch lever 43 and the shoe holder 55. The linking unit 51 includes the slide body 91 and the conversion member (the swing lever 92 and the press lever 93). The slide body 91, in conjunction with the switch lever 43, slides along the moving direction of the switch lever 43, and includes the guide rail 110. The conversion member includes the roller 119 that slides on the guide rail 110 and moves to the direction of advance and retreat of the shoe holder 55 corresponding to the movement on the guide rail 110 in accordance with the sliding of the slide body 91 to move the shoe holder 55 forward and rearward. The guide rail 110 includes the upper guide surface 111 and the lower guide surface 112. The upper guide surface 111 moves the swing lever 92 and the press lever 93 with respect to the sliding of the slide body 91 in conjunction with the operation of the switch lever 43 from the switch 9 being in a state of OFF until being operated ON. The lower guide surface 112 moves the swing lever 92 and the press lever 93 with respect to the sliding of the slide body 91 in conjunction with the operation of the switch lever 43 after the switch 9 is operated ON. The lower guide surface 112 is formed to decrease the amount of movement of the swing lever 92 and the press lever 93 compared with the upper guide surface 111.

With the above configuration, the releasing and braking operation of the brake mechanism 8 is adjusted to the timing of ON and OFF operation of the switch 9. Further, a necessary force to continue pushing in the switch lever 43 is reduced after the switch 9 is operated ON. Therefore, easy operation of the switch lever 43 is ensured.

Furthermore, the amount of movement of the swing lever 92 and the press lever 93 when the roller 119 rolls on the upper guide surface 111 is larger than the amount of movement of the swing lever 92 and the press lever 93 when the roller 119 rolls on the lower guide surface 112. Therefore, it is possible to quickly release the braking on the brake plate 53 by increasing the moving velocity of the swing lever 92 and the press lever 93 at the operation initial stage of the switch lever 43.

Since the guide shafts 106, 106 are provided so as to slidably guide the slide body 91 along the moving direction of the switch lever 43, the guide shafts 106, 106 receive the load applied to the slide body 91 from the swing lever 92 and the press lever 93. Accordingly, even though the linking unit 51 is disposed, the load at the push-in operation of the switch lever 43 can be reduced.

Meanwhile, since the seal ring 65 is disposed to seal between the shoe holder 55 and the base 52, the dust-proof between the shoe holder 55 and the base 52 is maintained even though the inside of the shoe holder 55 is ventilated. Therefore, a smooth front-rear movement of the shoe holder 55 is ensured.

The biasing means of the shoe holder 55 is the plurality of coil springs 57, 57 arranged on the concentric circle about the axial center of the shoe holder 55. Thus, the coil springs 57, 57 can be arranged overlapping the bearing portion 13, thereby ensuring achieving downsizing in the axial direction even though the brake mechanism 8 is disposed in the rear of the output shaft 12.

Furthermore, the linking unit 51 is unitized by housing the slide body 91, the swing lever 92, and the press lever 93 in the holding case 90, and the holding case 90 is supported by the housing 2. Therefore, assemblability of the linking unit 51 is improved, and interference with another wiring is reduced to lead to a protection of wiring.

The vibration absorbing rubber 37 is interposed between the motor housing 3 and the handle housing 7, and the brake portion 50 of the brake mechanism 8 is arranged inside the vibration absorbing rubber 37. Therefore, a space inside the vibration absorbing rubber 37 is effectively utilized.

Note that, the shape and the number of the fin disposed on the brake plate is not limited to the above-described configuration. It is changeable as necessary, for example, by entirely changing a height in the axial direction, changing a height from a center side to an outer side in the radial direction, or arranging in a manner other than the radial manner.

In the above-described configuration, the spiral ridge is formed on the inner peripheral surface of the base and the spiral groove is formed on the outer peripheral surface of the shoe holder. However, for example, a relationship between the ridge and the groove may be mutually switched. It is also allowed to use an inclination ridge and an inclination groove that inclines in a straight line not in a spiral pattern, or a plurality of projections may be arranged in the inclined direction instead of the ridge. The number can be increased and decreased, and the inclination groove and protrusion may be one each. The structure of the shoe holder itself is also allowed to, for example, be assembled by being integrated with the cap in a half-divided form, or change the number and the shape of the ventilation hole, small hole, and the circular arc groove.

The coil spring that biases the shoe holder can also have its number and position changed, and in case there is a spatial margin, one large diameter coil spring may configure the biasing means.

While in the linking unit, the roller is employed as the sliding portion, the projection, for example, in a shape of a ball or a spherical surface, other than the roller may be caused to slide along the groove disposed on the guide rail. The guide portion can also be set to have a further longer length of the upper guide surface or changed inclination angles of the upper and lower guide surfaces in the above-described configuration. It is not limited to the inclined surface, but it may be a curved surface. The number of the guide portion is not limited to two, but it is also possible to form three or more guide portions with inclined surfaces or curved surfaces to set different amounts of movement of the conversion member between the neighboring guide portions.

While in the above-described configuration, two levers, the swing lever and the press lever, are employed as the conversion member, one lever (conversion member) in which the two are integrated can also be employed.

Furthermore, the holding case can have a right and left divided structure instead of being divided into up and down, or can be a combination of three or more components. It is also possible to omit the holding case by disposing only a partition wall that simply partitions a space having the passage of airflow.

Moreover, the present invention is applicable even though the housing structure does not use the vibration absorbing member, a battery pack is used as the power source, a brushless motor is used as the motor, or the rotating tool is another rotating tool, such as a sander.

The invention claimed is:

1. A rotating tool comprising:

a motor in a housing;

a switch in the housing, the switch configured to be operated ON and OFF in accordance with an operation of an operation member to control a rotation of an output shaft of the motor;

a rotation shaft in the housing, the rotation shaft being configured to rotate in accordance with the rotation of the output shaft to rotate a tool bit; and a brake mechanism in the housing, the brake mechanism being controllable with respect to a brake plate that integrally rotates with the output shaft, wherein the brake plate is made of a disk-shaped metal and comprises a plurality of the fins that are upright in a radial direction of the brake plate and at regular intervals in a circumferential direction of the brake plate, the brake plate has a center on which a cylindrical portion extending to a side of the output shaft is integrally formed, and the cylindrical portion is externally mounted on and key-connected to a coupling shaft that is coaxial with the output shaft.

2. The rotating tool according to claim 1, wherein the fins are upright on an outer periphery portion of the brake plate, and the brake plate is retained by a circular plate and a bolt, the circular plate being in contact with a center on an inner side of the fin,the fins, the bolt passing through the circular plate to be threadably mounted on a center of the coupling shaft.

3. The rotating tool according to claim 1, wherein the housing includes a motor housing that houses the motor and a handle housing coupled to a rear of the motor housing, a vibration absorbing member is between the motor housing and the handle housing, and at least a part of the brake mechanism is inside the vibration absorbing member.

4. A rotating tool comprising:

a motor in a housing;

a switch in the housing, the switch configured to be operated ON and OFF in accordance with an operation of an operation member to control a rotation of an output shaft of the motor;

a rotation shaft in the housing, the rotation shaft being configured to rotate in accordance with the rotation of the output shaft to rotate a tool bit; and a brake mechanism in the housing, the brake mechanism being controllable with respect to a brake plate that integrally rotates with the output shaft, wherein the brake plate includes a fin, the brake mechanism includes:

a cylinder-shaped shoe holder that holds a brake shoe that is configured to brake the brake plate by abutting on the brake plate;

a cylinder-shaped base that holds the shoe holder movable forward and rearward with respect to the brake plate; and a biasing member that biases the shoe holder to a side of the brake plate, one of an outer peripheral surface of the shoe holder or an inner peripheral surface of the base includes an inclination groove that inclines with respect to an axial direction of the shoe holder and another of the outer peripheral surface of the shoe holder or the inner peripheral surface of the base includes a protrusion that fits to the inclination groove, and the shoe holder is configured to, while rotating by a guide of the inclination groove and the protrusion, bring the brake shoe into contact with the brake plate when the shoe holder moves to the brake plate side.

5. The rotating tool according to claim 4, wherein the brake mechanism includes a linking mechanism between the operation member and the shoe holder, the linking mechanism configured to link with a movement of the operation member to move the shoe holder forward and rearward, the linking mechanism includes:

a slide body that is configured to, in conjunction with the operation member, slide along a moving direction of the operation member, the slide body including a guide portion; and a conversion member that includes a sliding portion that is configured to slide on the guide portion and move in a direction of advance and retreat of the shoe holder corresponding to a movement of the guide portion in accordance with sliding of the slide body to move the shoe holder forward and rearward, and at least two of the guide portions are configured to move the conversion member in response to sliding of the slide body in conjunction with an operation of the operation member from at least the switch being in an OFF state until being operated ON, and amounts of movement of the conversion member between the neighboring guide portions are mutually different.

6. The rotating tool according to claim 5, wherein the linking member includes at least first and second conversion members, and the at least first and second conversion members and the guide portion are configured such that:

the sliding portion of the first conversion member slides before the sliding portion of the second conversion member; and an amount of movement of the first conversion member is larger than an amount of movement of the second conversion member.

7. The rotating tool according to claim 5, comprising a shaft member that is configured to slidably guide the slide body along a moving direction of the operation member.

8. The rotating tool according to claim 4, comprising a seal member that seals between the shoe holder and the base.

9. The rotating tool according to claim 4, wherein the biasing member is a plurality of coil springs arranged on a concentric circle about an axial center of the shoe holder.

10. The rotating tool according to claim 4, wherein the linking mechanism is unitized by housing at least the slide body and the conversion member in a holding case, and the holding case is supported in the housing.

* * * * *